US012486762B2

(12) United States Patent
Larbi Zeghlache

(10) Patent No.: US 12,486,762 B2
(45) Date of Patent: Dec. 2, 2025

(54) SYSTEMS AND METHODS FOR UNTETHERED WELLBORE INVESTIGATION USING MODULAR AUTONOMOUS DEVICE

(71) Applicant: SAUDI ARABIAN OIL COMPANY, Dhahran (SA)

(72) Inventor: Mohamed Larbi Zeghlache, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 37 days.

(21) Appl. No.: 18/410,766

(22) Filed: Jan. 11, 2024

(65) Prior Publication Data

US 2025/0230746 A1 Jul. 17, 2025

(51) Int. Cl.
*E21B 23/04* (2006.01)
*E21B 47/12* (2012.01)

(52) U.S. Cl.
CPC ..... *E21B 47/138* (2020.05); *E21B 23/04* (2013.01)

(58) Field of Classification Search
CPC ... E21B 23/0413; E21B 47/138; B63B 22/20; B63B 22/26; B63B 22/06; B63B 22/08
See application file for complete search history.

(56) References Cited

U.S. PATENT DOCUMENTS 2,092,316 A 9/1937 Lane
2,558,427 A 6/1951 Fagan
2,563,254 A 8/1951 Lewis
3,163,487 A 12/1964 Buck
3,487,484 A 1/1970 Holmes
3,535,623 A 10/1970 Price et al.
3,885,212 A 5/1975 Herbert
4,023,092 A 5/1977 Rogers
4,187,909 A 2/1980 Erbstoesser
4,218,651 A 8/1980 Ivy
4,224,707 A 9/1980 Mariani
(Continued)

FOREIGN PATENT DOCUMENTS

CA 2858051 C 11/2016
CN 2725529 9/2005
(Continued)

OTHER PUBLICATIONS americanpiezo.com [online]. "Stripe Actuators," available on or before Mar. 13, 2011, via Internet Archive: Wayback Machine URL<https://web.archive.org/web/20110313073802/https://www.americanpiezo.com/standardproducts/stripe-actuators.html>, [retrieved on Apr. 6, 2018], retrieved from: URL<https://www.americanpiezo.com/standard-products/stripe-actuators.html> (2 pages).
(Continued)

*Primary Examiner* — Cathleen R Hutchins
(74) *Attorney, Agent, or Firm* — Osha Bergman Watanabe & Burton LLP

(57) ABSTRACT

Methods and systems are discussed. In some cases, the methods may include deploying a modular untethered downhole tool in a wellbore. The modular untethered downhole tool includes a positive buoyant system and a sensing system with a sensor. The sensing system is threadedly attached to the positive buoyant system. The positive buoyant system may be replaced by threading a replacement positive buoyant system to the sensing system.

20 Claims, 15 Drawing Sheets

(56) References Cited

U.S. PATENT DOCUMENTS 4,258,318 A 3/1981 Furukawa et al.
4,258,568 A 3/1981 Boetes et al.
4,408,488 A 10/1983 Marshall
4,442,403 A 4/1984 Pohler
4,589,285 A 5/1986 Savit
4,611,664 A 9/1986 Osterhoudt, III et al.
4,650,281 A 3/1987 Jaeger et al.
4,662,209 A 5/1987 Brown
4,754,640 A 7/1988 Fitzgerald et al.
4,777,819 A 10/1988 Hoyt et al.
4,808,925 A 2/1989 Baird
4,855,820 A 8/1989 Barbour
4,983,912 A 1/1991 Roehrlein et al.
5,050,674 A 9/1991 Soliman et al.
5,096,277 A 3/1992 Kleinerman
5,158,440 A 10/1992 Cooper et al.
5,177,997 A 1/1993 Maciejewski
5,188,837 A 2/1993 Domb
5,219,245 A 6/1993 Chin-Yee
5,241,028 A 8/1993 Tucker
5,335,542 A 8/1994 Ramakrishnan et al.
5,387,863 A 2/1995 Lo et al.
5,494,413 A 2/1996 Campen et al.
5,514,016 A 5/1996 Larson
5,555,945 A 9/1996 Schultz et al.
5,579,283 A 11/1996 Owens et al.
5,579,287 A 11/1996 Boucher et al.
5,634,426 A 6/1997 Tomlinson et al.
5,649,811 A 7/1997 Krol, Jr. et al.
5,720,345 A 2/1998 Price et al.
5,729,607 A 3/1998 DeFries et al.
5,745,833 A 4/1998 Abe et al.
5,767,668 A 6/1998 Durand
5,789,669 A 8/1998 Flaum
5,816,874 A 10/1998 Juran et al.
5,944,195 A 8/1999 Huang et al.
6,057,750 A 5/2000 Sheng
6,076,046 A 6/2000 Vasudevan et al.
6,084,403 A 7/2000 Sinclair et al.
6,241,028 B1 6/2001 Bijleveld et al.
6,250,848 B1 6/2001 Moridis et al.
6,380,534 B1 4/2002 Farhadiroushan et al.
6,411,084 B1 6/2002 Yoo
6,446,718 B1 9/2002 Barrett et al.
6,534,980 B2 3/2003 Toufaily et al.
6,543,538 B2 4/2003 Tolman et al.
6,555,807 B2 4/2003 Clayton et al.
6,634,426 B2 10/2003 McCoy et al.
6,675,892 B2 1/2004 Kuchuk et al.
6,745,833 B2 6/2004 Aronstam et al.
6,808,371 B2 10/2004 Niwatsukino et al.
6,811,382 B2 11/2004 Buchanan et al.
6,832,515 B2 12/2004 Follini et al.
6,853,200 B2 2/2005 Munser et al.
6,856,132 B2 2/2005 Appel et al.
6,896,056 B2 5/2005 Mendez et al.
6,976,535 B2 12/2005 Aronstam et al.
7,021,905 B2 4/2006 Torrey et al.
7,024,930 B2 4/2006 Follini et al.
7,031,841 B2 4/2006 Zazovsky et al.
7,032,661 B2 4/2006 Georgi et al.
7,036,578 B2 5/2006 Austbo et al.
7,049,272 B2 5/2006 Sinclair et al.
7,054,751 B2 5/2006 Craig
7,117,734 B2 10/2006 Follini et al.
7,168,494 B2 1/2007 Starr et al.
7,210,334 B2 5/2007 Seghers et al.
7,263,880 B2 9/2007 Pop et al.
7,290,443 B2 11/2007 Follini et al.
7,322,416 B2 1/2008 Burris, II et al.
7,363,967 B2 4/2008 Burris, II et al.
7,376,514 B2 5/2008 Habashy et al.
7,387,165 B2 6/2008 Lopez de Cardenas et al.
7,445,043 B2 11/2008 Mullins et al.
7,495,350 B2 2/2009 Pinkerton et al.
7,622,915 B2 11/2009 Sugiyama et al.
7,788,037 B2 8/2010 Soliman et al.
7,831,205 B2 11/2010 Jack et al.
7,898,494 B2 3/2011 Brune et al.
8,015,869 B2 9/2011 Nold, III et al.
8,074,713 B2 12/2011 Ramos et al.
8,136,470 B1 3/2012 Buescher et al.
8,229,699 B2 7/2012 Jin
8,237,444 B2 8/2012 Simon
8,269,501 B2 9/2012 Schmidt et al.
8,272,455 B2 9/2012 Guimerans et al.
8,584,519 B2 11/2013 Maida et al.
8,638,104 B2 1/2014 Barber et al.
8,661,907 B2 3/2014 Davis et al.
8,794,062 B2 8/2014 DiFoggio et al.
8,816,689 B2 8/2014 Colombo et al.
8,875,785 B2 11/2014 Coles
8,877,954 B2 11/2014 Giesenberg et al.
8,884,624 B2 11/2014 Homan et al.
8,885,559 B2 11/2014 Schmidt et al.
8,899,349 B2 12/2014 Rasmus et al.
8,981,957 B2 3/2015 Gano et al.
8,985,218 B2 3/2015 Bedouet et al.
9,033,045 B2 5/2015 Fincher
9,045,969 B2 6/2015 Waters et al.
9,051,829 B2 6/2015 Xie et al.
9,080,097 B2 7/2015 Gupta et al.
9,129,728 B2 9/2015 Edbury et al.
9,133,709 B2 9/2015 Huh et al.
9,328,578 B2 5/2016 Kumaran et al.
9,422,811 B2 8/2016 Bedouet et al.
9,477,002 B2 10/2016 Miller et al.
9,528,322 B2 12/2016 MacDonald
9,562,987 B2 2/2017 Guner et al.
9,587,477 B2 3/2017 Lafferty et al.
9,650,851 B2 5/2017 Whitsitt et al.
9,863,222 B2 1/2018 Morrow et al.
10,117,042 B2 10/2018 Akyildiz et al.
10,253,622 B2 4/2019 Jaaskelainen et al.
10,267,937 B2 4/2019 Hu
10,273,399 B2 4/2019 Cox et al.
10,301,910 B2 5/2019 Whitsitt et al.
10,308,865 B2 6/2019 Cox et al.
10,308,895 B2 6/2019 Vidal et al.
10,316,645 B2 6/2019 Ingraham et al.
10,323,644 B1 6/2019 Shakirov et al.
10,337,279 B2 7/2019 Frazier
10,349,249 B2 7/2019 Akyildiz et al.
10,364,629 B2 7/2019 Jacob et al.
10,400,584 B2 9/2019 Palomarez
10,444,065 B2 10/2019 Schmidt et al.
10,487,259 B2 11/2019 Cox et al.
10,501,682 B2 12/2019 Cox et al.
10,502,044 B2 12/2019 Fouda et al.
10,577,921 B2 3/2020 Donderici et al.
10,704,369 B2 7/2020 Zeghlache et al.
10,711,599 B2 7/2020 Jaaskelainen et al.
10,718,175 B2 7/2020 Cabot et al.
10,900,351 B2 1/2021 Deffenbaugh et al.
11,047,218 B2 6/2021 Zeghlache et al.
11,111,773 B1 9/2021 Zeghlache
11,125,061 B2 9/2021 Zeghlache et al.
11,242,743 B2 2/2022 Seren et al.
11,332,991 B2 5/2022 Seren et al.
11,391,855 B2 7/2022 Nasser et al.
11,578,590 B2 2/2023 Deffenbaugh et al.
11,702,925 B2 7/2023 Zeghlache
11,879,328 B2 1/2024 Seren et al.
11,913,329 B1 2/2024 Zeghlache et al.
11,939,860 B2 3/2024 Seren et al.
2002/0096322 A1 7/2002 Barrett et al.
2002/0185273 A1 12/2002 Aronstam et al.
2003/0052670 A1 3/2003 Miszewski
2003/0220204 A1 11/2003 Baran et al.
2003/0233873 A1 12/2003 Standen
2004/0108110 A1 6/2004 Zupanick
2004/0236512 A1 11/2004 DiFoggio et al.
2005/0152280 A1 7/2005 Pollin et al.
2005/0241824 A1 11/2005 Burris et al.

(56) References Cited

U.S. PATENT DOCUMENTS

2005/0241825 A1 11/2005 Burris et al.
2006/0076956 A1 4/2006 Sjolie et al.
2006/0090893 A1 5/2006 Sheffield
2006/0105052 A1 5/2006 Acar et al.
2006/0157239 A1 7/2006 Ramos et al.
2006/0213662 A1 9/2006 Creel et al.
2007/0027797 A1 2/2007 Claus et al.
2007/0051512 A1 3/2007 Markel et al.
2007/0079652 A1 4/2007 Craig
2007/0083331 A1 4/2007 Craig
2007/0114030 A1 5/2007 Todd et al.
2007/0277970 A1 12/2007 Botnmark et al.
2008/0008043 A1 1/2008 Jong
2008/0047337 A1 2/2008 Chemali et al.
2008/0290876 A1 11/2008 Ameen
2009/0173504 A1 7/2009 McElhinney et al.
2009/0211816 A1 8/2009 Williams
2009/0222921 A1 9/2009 Mukhopadhyay et al.
2009/0250207 A1 10/2009 May
2009/0254171 A1 10/2009 Heikkila
2009/0255669 A1 10/2009 Ayan et al.
2009/0264067 A1 10/2009 Pahlavan
2009/0264768 A1 10/2009 Courtney et al.
2009/0277625 A1 11/2009 Bai et al.
2009/0289627 A1 11/2009 Johansen et al.
2009/0302847 A1 12/2009 Knizhnik
2010/0191110 A1 7/2010 Insana et al.
2010/0200744 A1 8/2010 Pearce et al.
2010/0227557 A1 9/2010 Won et al.
2010/0241407 A1 9/2010 Hsu et al.
2010/0268470 A1 10/2010 Kamal et al.
2011/0030949 A1 2/2011 Weaver et al.
2011/0100634 A1 5/2011 Williamson
2011/0221443 A1 9/2011 Bittar et al.
2011/0253373 A1 10/2011 Kumar et al.
2011/0264429 A1 10/2011 Lee et al.
2012/0085538 A1 4/2012 Guerrero et al.
2012/0092960 A1 4/2012 Gaston et al.
2012/0111559 A1 5/2012 Deady et al.
2012/0135080 A1 5/2012 Bromberg et al.
2012/0145458 A1 6/2012 Downton
2012/0216628 A1 8/2012 Rezgui et al.
2012/0281643 A1 11/2012 Sun et al.
2012/0285695 A1 11/2012 Lafferty et al.
2013/0043887 A1 2/2013 Ziolkowski et al.
2013/0073208 A1 3/2013 Dorovsky
2013/0091292 A1 4/2013 Kim et al.
2013/0109261 A1 5/2013 Koene
2013/0118807 A1 5/2013 Yang
2013/0186645 A1 7/2013 Hall
2013/0192349 A1 8/2013 Ramkumar et al.
2013/0192823 A1 8/2013 Barrilleaux et al.
2013/0244914 A1 9/2013 Wu et al.
2013/0250812 A1 9/2013 Rath et al.
2013/0255939 A1 10/2013 Kumaran et al.
2013/0296453 A1 11/2013 Giesenberg et al.
2013/0312970 A1 11/2013 Lafitte et al.
2013/0332015 A1 12/2013 Dextreit
2013/0333872 A1 12/2013 Mcmillon et al.
2013/0341030 A1 12/2013 Brannon et al.
2014/0036628 A1 2/2014 Hill et al.
2014/0041862 A1 2/2014 Ersoz
2014/0060832 A1 3/2014 Mahoney et al.
2014/0076542 A1 3/2014 Whitsitt et al.
2014/0110102 A1 4/2014 Hall
2014/0133276 A1 5/2014 Volker et al.
2014/0151029 A1 6/2014 Parsche
2014/0159715 A1 6/2014 McEwen-King
2014/0182844 A1 7/2014 Wutherich et al.
2014/0190700 A1 7/2014 Tang et al.
2014/0200511 A1 7/2014 Boyden et al.
2014/0262232 A1 9/2014 Dusterhoft et al.
2014/0366069 A1 12/2014 Ramamurthi et al.
2015/0000657 A1 1/2015 Herder et al.
2015/0013983 A1 1/2015 Alwattari
2015/0036482 A1 2/2015 Schmidt et al.
2015/0050741 A1 2/2015 Tour et al.
2015/0075777 A1 3/2015 Walters et al.
2015/0075778 A1 3/2015 Walters et al.
2015/0075779 A1 3/2015 Walters et al.
2015/0094964 A1 4/2015 Kuroda et al.
2015/0101798 A1 4/2015 Buytaert et al.
2015/0107855 A1 4/2015 Murphree et al.
2015/0118501 A1 4/2015 Lu et al.
2015/0159079 A1 6/2015 Huh et al.
2015/0181315 A1 6/2015 Vuran et al.
2015/0192436 A1 7/2015 Farhadiroushan et al.
2015/0247818 A1 9/2015 Silvester et al.
2015/0264627 A1 9/2015 Perdomo
2015/0268370 A1 9/2015 Johnston et al.
2015/0275649 A1 10/2015 Orban et al.
2015/0319630 A1 11/2015 Åkerberg et al.
2015/0337874 A1 11/2015 Park et al.
2015/0338541 A1 11/2015 Nichols et al.
2015/0368547 A1 12/2015 Lesko et al.
2015/0376493 A1 12/2015 Huh et al.
2016/0025961 A1 1/2016 Tripathy
2016/0040514 A1 2/2016 Rahmani et al.
2016/0069163 A1 3/2016 Tolman et al.
2016/0083641 A1 3/2016 Gamage
2016/0109611 A1 4/2016 Simon
2016/0138964 A1 5/2016 Brengartner et al.
2016/0146662 A1 5/2016 Stokely et al.
2016/0168974 A1 6/2016 Donderici
2016/0168984 A1 6/2016 Fripp et al.
2016/0194954 A1 7/2016 Hay
2016/0251935 A1 9/2016 Jacob et al.
2016/0264846 A1 9/2016 Bennetzen et al.
2016/0305447 A1 10/2016 Dreiss et al.
2016/0320769 A1 11/2016 Deffenbaugh et al.
2017/0067328 A1 3/2017 Chauffe et al.
2017/0074093 A1 3/2017 Adebayo et al.
2017/0101865 A1 4/2017 Khalaj Amineh et al.
2017/0138187 A1 5/2017 Moronkeji et al.
2017/0154714 A1 6/2017 Katayama et al.
2017/0370189 A1 12/2017 MacDougall et al.
2018/0051553 A1 2/2018 Indo et al.
2018/0292558 A1 10/2018 Wilson et al.
2018/0306027 A1 10/2018 Sherman et al.
2018/0313735 A1 11/2018 Gallagher
2018/0320059 A1 11/2018 Cox et al.
2018/0328170 A1 11/2018 Jaaskelainen et al.
2018/0334903 A1 11/2018 Lehr et al.
2018/0363409 A1 12/2018 Frazier
2018/0371886 A1 12/2018 Zeghlache et al.
2019/0040734 A1 2/2019 Donderici et al.
2019/0086348 A1 3/2019 Difoggio
2019/0226900 A1 7/2019 Brengartner et al.
2019/0242808 A1 8/2019 Chen et al.
2020/0131899 A1* 4/2020 Chen ..... E21B 47/10
2020/0400013 A1 12/2020 McBride et al.
2021/0017827 A1 1/2021 Seren et al.
2021/0041591 A1 2/2021 Riachentsev et al.
2021/0140311 A1* 5/2021 Deffenbaugh ..... E21B 47/09
2021/0208046 A1 7/2021 Gonzalez et al.
2021/0364336 A1 11/2021 Machocki et al.
2022/0010648 A1 1/2022 Musso et al.
2022/0127953 A1 4/2022 Seren et al.
2022/0243583 A1 8/2022 Seren et al.
2022/0334286 A1 10/2022 Seren et al.
2023/0100331 A1 3/2023 Al Dossary
2023/0235655 A1 7/2023 Lei et al.

FOREIGN PATENT DOCUMENTS

CN 102268986 12/2011
CN 103441803 12/2013
CN 103701567 4/2014
CN 108112260 6/2018
CN 215565894 U 1/2022
DE 4419684 12/1995
EP 1181435 11/2004
EP 1721603 11/2006
EP 2163724 3/2010

(56) References Cited

FOREIGN PATENT DOCUMENTS

| | | | |
|---|---|---|---|
| EP | 2789793 | | 10/2014 |
| EP | 2801696 | | 11/2014 |
| EP | 3196402 | | 7/2017 |
| EP | 3289179 | | 3/2018 |
| EP | 2954151 | | 4/2020 |
| GB | 2306657 | | 5/1997 |
| GB | 2442745 | | 4/2011 |
| IN | 397521 | | 11/2017 |
| JP | 2000065659 | | 3/2000 |
| JP | 2002233270 | | 8/2002 |
| JP | 2004290096 | | 10/2004 |
| JP | 2008237167 | | 10/2008 |
| JP | 6518342 | | 5/2019 |
| KR | 102023741 | | 9/2019 |
| RU | 2025747 | | 12/1994 |
| WO | 1998046857 | | 10/1998 |
| WO | 2000023824 | | 4/2000 |
| WO | 0073625 | | 12/2000 |
| WO | 2004113677 | | 12/2004 |
| WO | 2009004336 | | 1/2009 |
| WO | 2011063023 | | 5/2011 |
| WO | 2011097063 | | 8/2011 |
| WO | 2011146866 | | 11/2011 |
| WO | 2012154332 | | 11/2012 |
| WO | 2012158478 | | 11/2012 |
| WO | 2012173608 | | 12/2012 |
| WO | 2013126388 | | 8/2013 |
| WO | 2013142869 | | 9/2013 |
| WO | 2014049698 | | 4/2014 |
| WO | 2014066793 | | 5/2014 |
| WO | 2014100275 | | 6/2014 |
| WO | 2015020642 | A1 | 2/2015 |
| WO | 2015044446 | A1 | 4/2015 |
| WO | 2015084926 | A1 | 6/2015 |
| WO | 2015086062 | A1 | 6/2015 |
| WO | 2015095168 | A1 | 6/2015 |
| WO | 2015134705 | A2 | 9/2015 |
| WO | 2016176643 | | 11/2016 |
| WO | 2017196357 | | 11/2017 |
| WO | 2017205565 | A1 | 11/2017 |
| WO | 2018022198 | A1 | 2/2018 |
| WO | 2018084865 | | 5/2018 |
| WO | 2019195923 | | 10/2019 |
| WO | 2020117231 | | 6/2020 |
| WO | 2020220087 | | 11/2020 |
| WO | 2020257742 | | 12/2020 |
| WO | 2021257339 | A1 | 12/2021 |
| WO | 2022011388 | | 1/2022 |
| WO | 2023/000169 | | 1/2023 |

OTHER PUBLICATIONS

Assaf et al., "Accurate Sensors Localization in Underground Mines or Tunnels," IEEE, 2015 (6 pages).
Bagaria et al., "Iron Oxide Nanoparticles Grafted with Sulfonated Copolymers are Stable in Concentrated Brine at Elevated Temperatures and Weakly Adsorb on Silica," ACS Applied Materials & Interfaces, Mar. 25, 2013, 5:8 (3329-3339) (11 pages).
Baker et al., "Permanent monitoring-looking at lifetime reservoir dynamics," Oilfield Review, 1995, 7:4 (32-46) (15 pages).
Bala et al., "Interaction of Different Metal Ions with Carboxylic Acid Group: A Quantitative Study," The Journal of Physical Chemistry A, Jun. 2007, 111:28 (6183-6190) (8 pages).
bayspec.com [online], "SuperGamut NIR Spectrometer," available on or before Feb. 2014, [retrieved Apr. 18, 2018], retrieved from: URL <http://www.bayspec.com/wpcontent/uploads/2014/02/BaySpec-Datasheet-nir-swir.pdf> (6 pages).
Bell et al., "Subsurface Discrimination Using Electromagnetic Induction Sensors," IEEE Transactions on Geoscience and Remote Sensing, Jun. 2001, 39:6 (8 pages).
Biswas et al., "Semidefinite Programming Approaches for Sensor Network Localization with Noisy Distance Measurements," IEEE Trans. on Automation Science and Engineering, Oct. 2006 (12 pages).
Blunt, "Effects of heterogeneity and wetting on relative permeability using pore level modeling", SPE Journal 2:01 (70-87), March 199 (19 pages).
Boman, "DAS technology expands fiber optic applications for oil, gas industry," Rigzone, May 4, 2015 (4 pages).
Bryant, et al., "Prediction of relative permeability in simple porous media" Phys. Rev. A, Aug. 1992 (8 pages).
Chappell, et al., "Comparison of methodological uncertainties within permeability measurements" Hydrological Processes, Jan. 2007 (11 pages).
Chen et al., "Aggregation Kinetics of Alginate-Coated Hematite Nanoparticles in Monovalent and Divalent Electrolytes," Environmental Science & Technology, Mar. 2006 (8 pages).
Chen et al., "Distributed Source Localization in Wireless Underground Sensor Networks," Transactions on Signal Processing, vol. 58, No. 11, Nov. 2010 (21 pages).
Chen et al., "Hydration Repulsion between Carbohydrate Surfaces Mediated by Temperature and Specific Ions," Scientific Reports, Jun. 23, 2016 (10 pages).
Cole et al., "Polyethylene Glycol Modified, Cross-Linked Starch-Coated Iron Oxide Nanoparticles for Enhanced Magnetic tumor Targeting," Biomaterials, Mar. 1, 2011 (11 pages).
Colombo, et al., "Quantifying surface-to-reservoir electromagnetics for waterflood monitoring in a Saudi Arabian carbonate reservoir," Geophysics, Nov. 2013 (17 pages).
Costa et al., "Distributed Weighted-Multidimensional Scaling for Node Localization in Sensor Networks," ACM Trans. Sen. Netw., Feb. 2006 (26 pages).
Cui et al., "Cross-Layer Energy and Delay Optimization in Small-Scale Sensor Networks," IEEE Transactions on Wireless Communications, Oct. 2007 (12 pages).
Danfoss, "Facts Worth Knowing about Frequency Converters," Handbook VL T Frequency Converters, Danfoss Engineering Tomorrow (180 pages).
De et al., "An Integrated Cross-Layer Study of Wireless CDMA Sensor Networks," IEEE Journal on Selected Areas in Communications, Sep. 2004 (15 pages).
DiCarlo et al., "Three-phase relative permeability of water-wet, oil-wet, and mixed-wet sandpacks" SPE Journal, Mar. 2000 (10 pages).
Dixit et al., "A pore-level investigation of relative permeability hysteresis in water-wet systems" SPE Journal, Jun. 1998 (9 pages).
elprocus.com [online], "Designing of 12V to 24 V DC Converter Circuit using LM324," available on or before 2013, retrieved from URL <https://www.elprocus.com/12v-to-24v-dc-converter-using-lm324/> (7 pages).
Fatt, "The network model of porous media" Petroleum Transactions, Dec. 1956 (38 pages).
Gulbahar et al., "A Communication Theoretical Modeling and Analysis of Underwater Magneto-Inductive Wireless Channels," IEEE Transactions on Wireless Communications, Sep. 2012 (9 pages).
Heiba et al., "Percolation theory of two-phase relative permeability" SPE Reservoir Engineering, Feb. 1992 (11 pages).
Hui, et al., "Effects of wettability on three-phase flow in porous media" J. Phys. Chem., Feb. 2000 (13 pages).
Jacobs et al., "Downhole fiber-optic monitoring: an evolving technology," Society of Petroleum Engineers, Journal of Petroleum Technology, Aug. 2014, Abstract only (2 pages).
Ji et al., "Beyond Convex Relaxation: A Polynomial-Time Non-Convex Optimization Approach to Network Localization," Proceedings IEEE INFOCOM, Apr. 2013 (9 pages).
Kannan et al., "Analysis of Flip Ambiguities for Robust Sensor Network Localization," IEEE Transactions on Vehicular Technology, May 2010 (14 pages).
Karalis, "Efficient Wireless Non-Radiative Mid-Range Energy Transfer," Annals of Physics, 2008 (15 pages).
Kisseleff et al., "Throughput of the Magnetic Induction Based Wireless Underground Sensor Networks: Key Optimization Techniques," IEEE Transactions on Communications, Dec. 2014 (14 pages).

(56) References Cited

OTHER PUBLICATIONS

Knaian, "Electropermanent magnetic connectors and actuators: devices and their application in programmable matter," PhD thesis, Massachusetts Institute of Technology, 2010 (206 pages).
Kramer, "Water-Soluble Dendritic Architectures with Carbohydrate Shells for the Templation and Stabilization of Catalytically Active Metal Nanoparticles," published by ACS, Macromolecules, Aug. 2005 (8 pages).
Li et al., "In Situ Estimation of Relative Permeability from Resistivity Measurements," Petroleum Geoscience, 2014 (10 pages).
Li, "Collaborative Localization with Received-Signal Strength in Wireless Sensor Networks," IEEE Transactions on Vehicular Technology, Nov. 2007 (11 pages).
Lin et al., "A Tutorial on Cross-Layer Optimization in Wireless Networks," IEEE Journal on Selected Areas in Communications, Aug. 2006 (12 pages).
Lin et al., "Magnetic Induction-Based Localization in Randomly-Deployed Wireless Underground Sensor Networks," IEEE Internet of Things Journal, Jul. 20, 2017 (11 pages).
machinedesign.com [online], Frances Richards, "Motors for efficiency: Permanent-magnet, reluctance, and induction motors compared," Apr. 2013, retrieved on Nov. 11, 2020, retrieved from URL <https://www.machinedesign.com/motors-drives/ article/2183 2406/ motors-for-efficiencypermanentmagnet- reluctance-and-induction-motors-compared> (4 pages).
Mahmud et. al "Effect of network topology on two-phase imbibition relative permeability" Transport in Porous Media, Feb. 2007 (14 pages).
Martinez et al., "Polysaccharide-based Nanoparticles for Controlled Release Formulations," The Delivery of Nanoparticles, May 2012 (39 pages).
Masihpour et al., "Multihop Relay Techniques for Communication Range Extension in Near-Field Magnetic Induction Communication Systems," Journal of Networks, 2013 (13 pages).
Nagy et al., "Comparison of permeability testing methods," Proceedings of the 18th International Conference on Soil Mechanics and Geotechnical Engineering, 2013 (4 pages).
Nie, "Sum of Squares Method for Sensor Network Localization," Computational Optimization and Annlications, 2007 (29 pages).
Niewiadomska-Szynkiewicz, "Localization in Wireless Sensor Networks: Classification and Evaluation of Techniques," Int. J. Annl. Mat. Comput. Sci., 2012 (17 pages).
Optasense.com [online], "Oilfield Services," available on or before Jun. 2, 2015, via Wayback Machine URL <https://web.archive.org/web/20150602040413/http://www.optasense.com/our-solutions/oilfieldservices/>, [retrieved Apr. 6, 2018], retrieved from URL <http://www.optasense.com/oursolutions/ oilfield-services/> (1 page).
piceramic.com [ online], "Rectangular Bending Elements," available on or before Mar. 31, 2017, via Internet Archive: Wayback Machine URL <https://web.archive.org/web/20170331054949/https://www.piceramic.com/en/products/piezoceramiccomponents/bending-elements/>, [retrieved Apr. 6, 2018], retrieved from: URL <https://www.piceramic.com/en/products/piezoceramic-components/bending-elements/>(2 pages).
Pompili et al., "A Multimedia Cross-Layer Protocol for Underwater Acoustic Sensor Networks," IEEE Transactions on Wireless Communications, Sep. 2010 (10 pages).
Purcell, "Capillary pressures—their measurement using mercury and the calculation of permeability therefrom" Journal of Petroleum Technology, Feb. 1949 (10 pages).
Nazli Demirer et al. "Autonomous Directional Drilling with Rotary Steerable Systems" 2019 American Control Conference (ACC) Philadelphia, PA, USA, Jul. 10-12, 2019 pp. 5203-5208 (6 pages).
Walt Aldred et al. "Drilling automation" Oilfield Review • Jul. 2012 pp. 18-27 (11 pages).
Notice for Reasons of Refusal issued by the Japanese Patent Office for Japanese patent application No. 2017-556568, mailed Dec. 18, 2018 (7 pages).
International Search Report issued for related International patent application No. PCT/US2016/030260, mailed Aug. 17, 2016 (5 pages).
Ukrainczyk, Neven, Stanislav Kurajica, and Juraj Sipusic. "Thermophysical comparison of five commercial paraffin waxes as latent heat storage materials." Chemical and Biochemical Engineering Quarterly 24.2 (2010): 129-137.
International Search Report issued for related International Patent Application No. PCT/US2020/038859, mailed Sep. 16, 2020 (3 pages).
Bar-Kochba et al., "A Fast Iterative Digital Volume Correlation Technique for Large Deformation Measurements," Experimental Mechanics, 55:, Feb. 2014, 261-274, 14 pages.
Buljac et al., "Digital volume correlation: review of progress and challenges," Experimental Mechanics, 58:5, 2018, 661-708, 127 pages.
Estrada et al., "Intuitive Interface for the Quantitative Evaluation of Speckle Patterns for Use in Digital Image and Volume Correlation Techniques," J. Applied Mechanics, 82:9 (095001), Sep. 2015, 5 pages.
Commons.wikimedia.org [online], "File:6DOF.svg" Feb. 2015, [retrieved on Apr. 7, 2021], retrieved from: URL <https://commons.wikimedia.org/w/index.php?curid=38429678>, 4 pages.
Hunting-intl.com [online], "Mechanical Centralizers and Decentralizers" Mar. 2015, [retrieved on Apr. 7, 2021], retrieved from: URL <http://www.hunting-intl.com/titan/wireline-hardware-andaccessories/ mechanical-centralizers-and-decentralizers>, 1 page.
Wikipedia.org [ online], "Metacentric Height" Nov. 2003, [ retrieved on Apr. 7, 2021], retrieved from: URL <https://en.wikipedia.org/wiki/Metacentric height>, 7 pages.
International Search Report issued for corresponding International Patent Application No. PCT/US2022/014664, mailed Apr. 25, 2022 (4 pages).
First Office Action issued by Chinese Patent Office for Chinese patent application No. CN2016800249134, mailed Sep. 1, 2020 (16 pages).
Notice of Allowance issued by Korean Patent Office for Korean patent application No. KR10-2019-7010194, mailed Apr. 21, 2020 (4 pages).
Examination Report issued by the Gulf Cooperation Council Patent Office for corresponding Gulf Cooperation Council patent No. GC2016-37391, mailed Oct. 7, 2019 (4 pages).
Office Action issued by Korean Patent Office for Korean patent application No. KR10-2019-7010194m mailed Oct. 29, 2019 (16 pages).
Seren, H. R. et al. "An Untethered Sensor Platform for Logging Vertical Wal.la", IEEE Transactions on Instrumentation and Measurement, vol. 67, No. 4, Apr. 1, 2018 pp. 798-803 (6 pages).
Zeghlache, M. L. et al. "Sensor-Ball: Field Deployment of Autonomous and Untethered Surveillance" International Petroleum Technologyconference, Riyadh, Saudi Arabia, [Online] Feb. 21, 2022 (6 pages).
Seren, H. R. et al. "Electro-permanent magnetic weight release mechanism for buoyancy control. of an autonomous 3 well-logging tool" AIP Advances, American Institute of Physics, 2 Huntington Quadrangle, ? Melville, NY 11747, vol. 11, No. 2, Feb. 9, 2021 (7 pages).
International Search Report issued in International Application No. PCT/US2023/032498 dated Jan. 26, 2024 (5 pages).
Written Opinion issued in International Application No. PCT/US2023/032498 dated Jan. 26, 2024 (10 pages).
Al Macki et al., "Electromagnetic Corrosion Logs, Insights from Yard Test," SPE-188672-MS, Society of Petroleum Engineers, presented at the Abu Dhabi International Petroleum Exhibition and Conference in Abu Dhabi, UAE, Nov. 13-16, 2017 (9 pages).
Alverez et al., "Design, realization and field results of an inductive casing collar locator," IEEE Sensors Applications Symposium (SAS), Apr. 12, 2017 (4 pages).
Alverez et al., "Theory, Design, Realization, and Field Results of an Inductive Casing Collar Locator," IEEE Transactions on Instrumentation and Measurement, Apr. 2018, 67(4):760-766 (7 pages).

(56) References Cited

OTHER PUBLICATIONS bubbletightusa.com [ online], "Innovative Materials," 2022, retrieved on Feb. 14, 2022, retrieved from URL <http://bubbletightusa.com/products/> (9 pages).
Buzi et al., "Sensor Ball: Modernized Logging." SPE-204 791-MS, Society of Petroleum Engineers, Dec. 2021 (6 pages).
Buzi et al., "Sensor Ball: An Autonomous Untethered Logging Platform," OTC-30538-MS, Paper presented at the Offshore Technology Conference, Houston, Texas, USA, May 2020 (10 pages).
Chen et al., "Synthesis of Disruptive Technologies Leads to Design ofFlowable Sensors for Reservoir Monitoring, Passively Retrievable Through Carrier Buoyancy," OTC-29599-MS, prepared for presentation at the Offshore Technology Conference held in Houston, Texas, USA, May 6-9, 2019 (12 pages).
Deffenbaugh et al., "An Untethered Sensor for Well Logging," IEEE Sensors Applications Symposium (SAS), 2017 (5 pages).
Delmonte, "Molding and Casting of Metal/Polymer Composites," Metal/polymer composites, Springer, 1990 (37 pages).
Gahlin et al., "The particle size effect in abrasion studied by controlled abrasive surfaces," Wear, Jan. 1999, 224(1):118-125 (8 pages).
Garcia et al., "Successful Application of a New Electromagnetic Corrosion Tool for Well Integrity Evaluation in Old Wells Complete with Reduced Diameter Tubular," IPTC.16997, International Petroleum Technology Conference, Beijing, China, Mar. 26-28, 2013 (12 pages).
Gardner et al., "Barrier Verification During Plug and Abandonment Using Spectral Noise Logging Technology, Reference Cells Yard Test," Society of Petroleum Engineers, SPE/IADC-194075-MS, SPE/IASDC Drilling International Conference and Exhibition in the Hauge, the Netherlands, Mar. 5-7, 2019 (22 pages).
Gasda et al., "Wellbore Permeability Estimates from Vertical Interference Testing of Existing Wells," Energy Procedia, vol. 37, Jan. 1, 2013 (8 pages).
Kuchuk et al., "The use of Vertical Interference Testing to improve reservoir interference testing to improve reservoir characterization," SPE, Oct. 18, 2000 (13 pages).
Pettitt-Schieber et al., "Testing Electromagnetic Multi-Pipe Thickness Tools in Azimuthally Constrained Defects for Deepwater Applications," Society of Petroleum Engineers, SPE-199870-MS, official proceedings for SPE/ICoTA Well Intervention Conference and Exhibition, Mar. 16, 2020 (12 pages).
Polyakov et al., "Dependence of magnetic permeability of ferromagnetic powder materials on particle size," Powder Metallurgy and Metal Ceramics, 1995, 33: 9-10 (2 pages).
Roy et al., "Strategic Alliance Enables Fast-Track Engineering and Expeditious Deployment of Novel Flowable Sensors & Water Reactive Nano-Composite Plugs in Mena," OTC-31118-MS, Offshore Technology Conference, 2021 (16 pages).
Seren et al., "Acoustic communication through well-head for untethered autonomous logging tool," The Journal of the Acoustical Society of America, 2020, 148, 2769, Abstract only (4 pages).
Seren et al., "Autonomous Well Logging Robot with Passive Locomotion," 21st International Conference on Control, Automation and Systems (ICCAS), Dec. 2021, Abstract only (3 pages).
Seren et al., "Untethered Well Logging Robot," Aramco Services Company, 2021, Summary (1 page).
Seren et al., "Wireless Communication and Charging for an Untethered Downhole Logging Tool," IEEE Sensors, Oct. 27-30, 2019 (3 pages).
tervesinc.com [online], "Dissolvables," 2017, retrieved on Feb. 14, 2022, retrieved from URL <https ://www .tervesinc.com/products/dissolvables/ (6 pages).
Zeghlache et al., "An Innovative Deployment Technique to Optimize Logging Conveyance and Improve Data Quality," IPTC-21206-MS, International Petroleum Technology Conference, 2021 (16 pages).
Zhao et al., "Advanced Compound Coating for Delaying Corrosion of Fast-Dissolving Alloy in High Temperature and Corrosive Environment", International Scholarly and Scientific Research & Innovation, 2021, 15(2):71-75 (5 pages).
Zheng et al., "Ultralight, ultrastiff mechanical metamaterials," Science, Jun. 2014, 344( 6190): 13 73-1377 (6 pages).
Agbinya, "A Magneto-Inductive Link Budget for Wireless Power Transfer and Inductive Communication Systems," Progress in Electro magnetics Research C, 2013, 37: 15-28 (14 pages).
Agbinya, "Investigation of Near Field Inductive Communication System Models, Channels and Experiments," Progress in Electromagnetics Research B, 2013, 49: 129-153 (25 pages).
Akyildiz et al., "SoftWater: Software-Defined Networking for Next-Generation Underwater Communication Systems," Ad Hoc Networks, Apr. 8, 2016, 46: 1-11 (11 pages).
Rahmani et al., "Characterizing Reservoir Heterogeneities Using Magnetic Nanoparticles," SPE Reservoir Simulation Symposium, May 2015 (25 pages).
Rio-lasers.com [ online], "Redfern Integrated Optics (RIO) Colorado Tunable Laser Source," available on or before Sep. 1, 2016, via Wayback Machine URL 249. <https://web.archive.org/web/2016090 I I 72454/http://www.riolasers.com/pdf/Rio_ Colorado_Product%20Brief_I.24.14.pdf> [retrieved Apr. 6, 2018], retrieved from URL <http://www.rio-lasers.com/pdf/Rio Colorado Product Brief 1.24.14.pdf> (2 pages).
Saeki et al., "Upper and lower critical solution temperatures in poly (ethylene glycol) solutions," Polymer, 1976 (5 pages).
Slb.com [ online], "Distributed Acoustic Sensing Technology." available on or before Feb. 11, 2017, via Wayback Machine URL <https://web.archive.org/web/20170211002616/https://www.slb.com/services/characterization/geophysics/wireline/distributed-acoustic-seismic-sensing.aspx>, [retrieved on Apr. 6, 2018] (1 page).
Sedlar et al., "Optical fiber magnetic field sensors with ceramic magnetostrictive jackets," Applied Optics, Sep. 20, 1996, abstract only (2 pages).
ShamsiJazeyi et al., "Polymer-Coated Nanoparticles for Enhance Oil Recovery," Journal of Applied Polymer Science, Aug. 5, 2014 (13 pages).
Vuran et al., "XLP: A Cross-Layer Protocol for Efficient Communication in Wireless Sensor Networks," IEEE Transactions on Mobile Computing, Nov. 2010 (14 pages).
Vuran et al., "Communication Through Soil in Wireless Underground Sensor Networks—Theory and Practice," 2010 (39 pages).
Wikipedia.com [online], "Distributed acoustic sensing", Jan. 17, 2012, [retrieved on Feb. 23, 2018], retrieved from URL <https://en.wikipedia.org/wiki/Distributed acoustic sensing> (5 pages).
Simonetto et al., "Distributed Maximum Likelihood Sensor Network Localization," IEEE Transactions on Signal Processing, Mar. 15, 2014 (14 pages).
Simpson et al., "A Touch, Truly Multiphase Downhole Pump for Unconventional Wells," SPE-185152-MS, Society of Petroleum Engineers (SPE), presented at the SPE Electric Submersible Pump Symposium, the Woodlands, Texas, Apr. 24-28, 2017 (20 pages).
steminc.com [online], "Piezo Ceramic Plate 26×8×0.7mm 108 KHz," available on or before Dec. 30, 2013, via Internet Archive Wayback Machine URL<https://web.archive.org/web/20131230010212/https://www.steminc.com/PZT/en/piezo-ceramincplate-26x8x7mm-108-khz>, [retrieved on Apr. 6, 2018], retrieved from URL <https://www.steminc.com/PZT /en/piezo-ceraminc-plate-26x8x7mm-I 08-khz> (1 page).
Sun et al., "Design of the fiber optic distributed acoustic sensor based on Michelson interferometer and its location application," Optical Engineering, 42, Oct. 1, 2003, Abstract only (1 page).
Sun et al., "Optimal Deployment for Magnetic Induction-Based Wireless Networks in Challenged Environments," IEEE Transactions on Wireless Communications, Mar. 2013 (10 pages).
Udd, "An overview of fiber-optic sensors," Review of Science Instruments, Jun. 1995, Abstract only (16 pages).
Yamamoto, "Imaging the permeability structure within the near-surface sediments by acoustic crosswell tomography," Journal of Applied Geophysics, May 2001 (11 pages).
Zhan et al., "Characterization of Reservoir Heterogeneity Through Fluid Movement Monitoring with Deep Electromagnetic and Pressure Measurements," SPE 1163 28, Society of Petroleum

(56) References Cited

OTHER PUBLICATIONS

Engineers(SPE), SPE International, presented at the 2008 SPE Annual Technical Conference and Exhibition, Sep. 21-24, 2008 (16 pages).
Zhao et al., "Chromatographic Separation of Highly Soluble Diamond Nanoparticles Prepared by Polyglycerol Grafting," Angewandte Chemie International Edition, Feb. 7, 2011 (5 pages).
Varela et al., "Wireless Advanced Nano-Devices for Well Monitoring," Abu Dhabi International Petroleum Exhibition & Conference, Nov. 2020 (18 pages).
Shi et al., "Development and field evaluation of a distributed microchip downhole measurement system," SPE Digital Energy Conference and Exhibition, Mar. 2015 (14 pages).
Seren et al., "Miniaturized Casing Collar Locator for Small Downhole Robots," IEEE Sensors Letters 6.4, Mar. 2022 (4 pages).
petrowiki.spe.org [online], "Seismic profiling," Jun. 2015, retrieved Sep. 14, 2022, from URL <https://petrowiki.spe.org/Seismic_profiling> (11 pages).
Olofsson et al., "Ensuring correct clock timing in ocean bottom node acquisition," SEG Annual Meeting, Oct. 2010 (5 pages).
Ojo et al., "Water Quality Measurements using a Novel Buoyancy Controlled Drifting Sensor Platform (BcDSP)," Syracuse Center of Excellence, Clarkson University, CARTI Presentation, Apr. 2010 (27 pages).
Liu et al., "Down-hole robots: current status, challenge and innovation," 2013 IEEE International Conference on Mechatronics and Automation, Aug. 2013 (5 pages).
Liu et al, "Acoustic Wave-Based Method of Locating Tubing Leakage for Offshore Gas Wells", Energies, MDPI, 2018 (21 pages).
Kim et al, "Development of the inpipe robot for various sizes," 2009 IEEE/ ASME International Conference on Advanced Intelligent Mechatronics, Jul. 2009 (5 pages).
Campbell et al., "Vertical seismic profiles-More than just a corridor stack," The Leading Edge, Jul. 2005 (4 pages).
Buzi et al., "Sensor Ball: Autonomous, intelligent logging platform," OTC-31149-MS, Offshore Technology Conference, 2021 (13 pages).
International Search Report issued for corresponding international patent applicaton No. PCT/US2020/041984, mailed Oct. 22, 2020 (4 pages).
Written Opinion issued for corresponding international patent applicaton No. PCT/US2020/041984, mailed Oct. 22, 2020 (10 pages).
Written Opinion issued for related International Patent Application No. PCT/US2020/038859, mailed Sep. 16, 2020 (7 pages).
Written Opinion issued for related International patent application No. PCT/US2016/030260, mailed Aug. 17, 2016 (5 pages).
Written Opinion issued for corresponding International Patent Application No. PCT/US2022/014664, mailed Apr. 25, 2022 (7 pages).
International Search Report issued for corresponding international patent application No. PCT/US2022/074524, mailed Nov. 16, 2022 (3 pages).
Written Opinion issued for corresponding international patent application No. PCT/US2022/074524, mailed Nov. 16, 2022 (6 pages).

* cited by examiner

SYSTEMS AND METHODS FOR UNTETHERED WELLBORE INVESTIGATION USING MODULAR AUTONOMOUS DEVICE

BACKGROUND

Investigation of wellbores in the oil and gas industry typically involves deploying a downhole tool into a wellbore that is attached to the surface of the wellbore by a conveyance system such as, for example, a wireline, a slick line, coil tubing or drill pipes. Such tethered conveyance systems can be problematic. Untethered downhole tools avoid many problems associated with the tethered conveyance systems, but in some cases can involve considerable costs due to damage or becoming stuck in the wellbore.

Hence, there is a need in the art for advanced methods and systems for wellbore investigation using untethered downhole tools.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a modular untethered downhole tool system for deployment in a fluid in a wellbore. The modular untethered downhole tool system includes: a first positive buoyant system, a second positive buoyant system, and a sensing system. The first positive buoyant system may exhibit a first volume and a first density and includes a first connector. The second positive buoyant system may exhibit a second volume and a second density and includes a second connector. The combination of the second volume and the second density provides a greater buoyancy than a combination of the first volume and a first density. The sensing system includes: a housing having an inner volume, a sensor within the inner volume configured to sense a parameter within a wellbore, a memory within the inner volume configured to store the parameter, a controller within the inner volume configured to control storage of the parameter to the memory, and a third connector that is interchangeably connectable to either of the first connector or the second connector.

In general, in one aspect, embodiments relate to methods for logging data in a wellbore filled with a fluid. The methods include deploying a modular untethered downhole tool in a wellbore. The modular untethered downhole tool includes: a positive buoyant system; a sensing system having a sensor, and a negative buoyant system. The sensing system is threadedly attached to the positive buoyant system. The negative buoyant system is releasably attached to the sensing system, where a first combination of the positive buoyant system, the sensing system, and the negative buoyant system is negatively buoyant in the fluid, and wherein a second combination of the positive buoyant system and the sensing system is positively buoyant in the fluid.

The methods further include: logging at least a first parameter within the wellbore using a sensor in the sensing system; releasing the negative buoyant system from the modular untethered downhole tool to yield a remaining downhole tool; retrieving the remaining downhole tool at a surface of the wellbore; unthreading the positive buoyant system of the remaining downhole tool from the sensing system of the remaining downhole tool; and threading a replacement positive buoyant system to the sensing system of the remaining downhole tool to yield an updated downhole tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
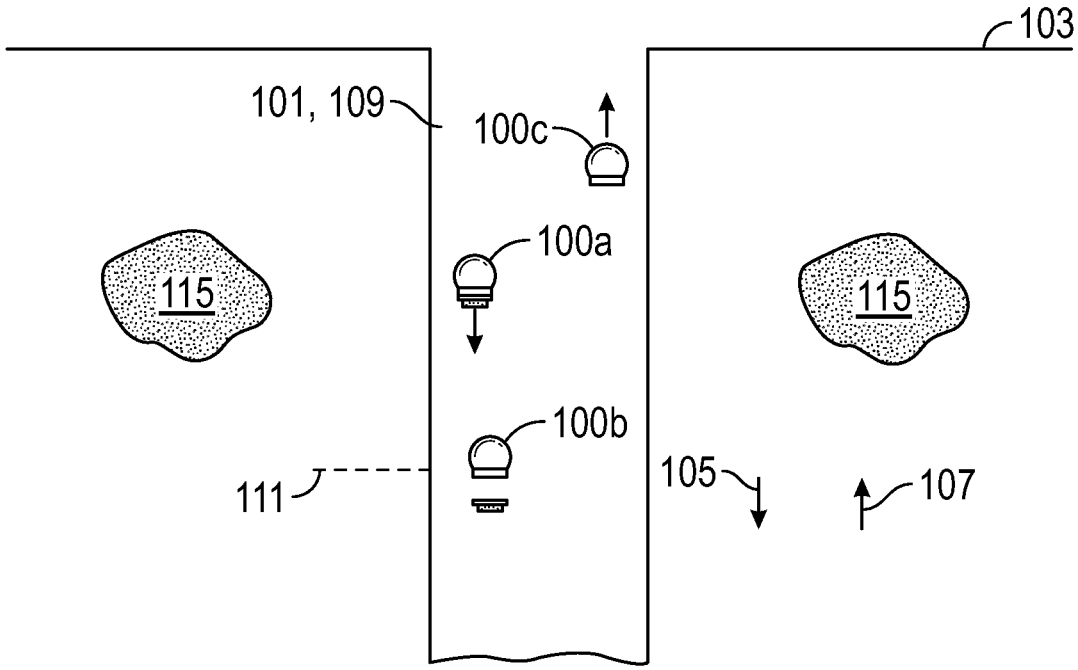
FIG. 1 depicts a wellbore into which a modular untethered downhole tool in accordance with some embodiments may be deployed.

Various embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "cell" includes reference to one or more of such cells.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

As used herein, the phrases "positively buoyant", "positive buoyant", and/or "positive buoyancy" are used in their broadest sense to mean a tendency to float in a given fluid or move upward in the given fluid. Thus, an element with a density less than oil is positively buoyant in oil. As used herein, the phrases "negatively buoyant", "negative buoyant", and/or "negative buoyancy" are used in their broadest sense to mean a tendency to sink in a given fluid. Thus, an element with a density greater than oil is negatively buoyant in oil.

It is to be understood that one or more of the elements shown in any flowchart presented herein may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

In the following description of FIGS. 1-9, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Well logging and intervention are processes of obtaining information about the subsurface of a wellbore by measuring physical properties such as, for example, formation pressure, temperature, and/or fluid content. Such logging and intervention typically involves deploying a downhole tool tethered to the surface by a conveyance system such as, for example, a wireline, a slick line, coil tubing, or drill pipes. Wireline is a commonly used conveyance system for logging tools and consists of a cable that is lowered into the wellbore. Wirelines is a versatile and efficient system that can be used for both logging and intervention operations. Slick line is a simpler conveyance system than wireline, consisting of a single strand of wire used to lower and retrieve downhole tools. Slick line is typically used for basic intervention tasks such as setting or retrieving plugs, valves, or other downhole equipment. Coil tubing is a continuous length of tubing that is used to convey tools downhole and is commonly used for well intervention operations such as cleaning and acidizing, as well as for logging operations. Drill pipes are used for drilling and are not typically used for well intervention or logging operations, however, they can be used for conveying tools downhole if necessary.

Tractors are also a type of downhole conveyance system used in oil and gas wells. Tractors are motorized devices that are attached to a tool string and are used to propel the downhole tool downhole. Tractors can move tools through highly deviated or horizontal wellbores, which may be difficult or impossible to access using traditional conveyance systems like wireline or coil tubing. Tractors are often used for complex intervention operations that require precise positioning of the tools in the wellbore and can be operated in either autonomous or semi-autonomous mode. Some tractor models are equipped with sensors and imaging systems to provide real-time feedback on downhole conditions. Tractors may be capable of navigating tight curves and obstacles in the wellbore, which can improve the efficiency and effectiveness of well intervention operations. The use of tractors in well intervention has increased in recent years due to advancements in technology and the need for more efficient and cost-effective intervention methods. However, tractors are still relatively expensive and may not be suitable for all well intervention operations. The selection of the appropriate conveyance system, including tractors, depends on the specific requirements of the operation and the available budget.

Autonomous downhole tools may be used in well intervention and logging operations in the oil and gas industry to improve the safety, efficiency, and accuracy of intervention and logging operations. Autonomous downhole tools may be motorized such that they can move themselves within a wellbore. Such tools offer a great deal of control when moving around within a wellbore. Other autonomous downhole tools rely upon gravity and fluid flows within a wellbore for movement and may provide lower complexity. In many cases, autonomous downhole tools may be configured to operate independent of any human supervision or with only minimal human supervision.

Autonomous downhole tools can be configured to perform a wide range of tasks, including, but not limited to: logging which involves, among other things, measuring and recording downhole parameters such as temperature, pressure, fluid flow rate, and other physical properties of a reservoir; intervention which involves, among other things, setting or retrieving plugs, valves, and other downhole equipment; inspection which involves, among other things, providing sensed inspection of a wellbore using cameras and other sensors to inspect and analyze downhole conditions and identify potential problems; and/or sampling which includes, among other things, collecting fluid and/or rock samples from a reservoir for analysis.

In some cases, autonomous downhole tools may be conveyed into a wellbore using various conveyance systems, including wireline, slickline, coil tubing, or tractor. Such autonomous downhole tools are referred to herein as tethered autonomous downhole tools.

In other cases, autonomous downhole tools may be deployed into a wellbore by dropping the device into a wellbore and allowing gravity to convey the downhole tool to a depth in the wellbore. Once the autonomous downhole tool reaches a desired depth, the tool may perform its intended function, such as taking measurements or collecting samples. After completing the operation, the downhole tool is designed to detach a negative buoyant system causing the downhole tool to float back to a surface of the wellbore. Such autonomous downhole tools are referred to herein as untethered downhole tools.

To achieve autonomous operation, untethered downhole tools may be equipped with a variety of sensors, communication devices, collection gathering devices, and/or power sources. For example, such a downhole tool may have onboard batteries or use energy-harvesting technology to power its operation. Such untethered downhole tools may also be equipped with sensors that detect depth, temperature, pressure, and other downhole conditions, allowing it to adapt its behavior and optimize its performance. Use of untethered autonomous downhole tools may be beneficial in situations where traditional conveyance systems are not feasible or cost-effective. For example, untethered downhole tools may find applicability in highly deviated or horizontal wellbores where wireline or coil tubing may be difficult to maneuver. Untethered downhole tools may also be applicable for use in remote locations where rig access is limited or where rapid deployment is required. Based upon the disclosure provided herein, one of ordinary skill in the art will recognize a number of situations to which an untethered downhole tool may be applied.

Some embodiments provide modular untethered downhole tools each including at least three component systems: at least one sensing system, at least one positive buoyant system that is positively buoyant in a wellbore fluid, and at least one negative buoyant system that is negatively buoyant in the wellbore fluid. The positive buoyant system may be removably attachable to the sensing system, and the negative buoyant system may be releasably attached to the sensing system. In some embodiments, the sensing system includes a male threaded portion, and the positive buoyant system includes a female threaded portion that matches the male threaded portion of the sensing system. In such embodiments, the positive buoyant system may be easily attached to the sensing system by screwing the sensing system into the positive buoyant system. In other embodiments, each of the sensing system and the positive buoyant system includes a male threaded portion, and a female threaded portion is attached to each of the sensing system and the positive buoyant system. In such embodiments, the male threaded portion is configured to be screwed into the female threaded portion. Again, in such embodiments, a number of positive buoyant systems and/or sensing systems may be easily assembled in a desired order using the respective male and female threaded portions.

Further, in some embodiments a variety of positive buoyant systems are available each offering a different combination of volume and density (i.e., buoyancy) in the wellbore fluid and/or shape; and a variety of sensing systems are available each offering a different set of sensors and/or operational capabilities. In such an embodiment, a user can select one or more desired sensing systems and one or more desired positive buoyant systems to create a customized modular untethered downhole tool using interchangeable component systems.

Such modular untethered downhole tools provide flexibility allowing an operator to select one of many positive buoyant systems that are interchangeable. As an example, an operator may replace a small foam positive buoyant system having a combination of volume and density offering a first positive buoyancy in a given fluid with a larger foam positive buoyant system having a combination of volume and density offering a second positive buoyancy where the second positive buoyancy is more buoyant in the given fluid than the first positive buoyancy. Such a modular untethered downhole tool having a greater buoyancy may be desirable for use in a wellbore that is filled with less dense fluids. As another example, an operator may replace one positive buoyant system when it has been damaged with another positive buoyant system of the same type. In some cases, the positive buoyant systems may be relatively inexpensive when compared with the sensing systems. The modularity allows for continued use of the same sensing systems after the positive buoyant systems have been damaged. As yet another example, an operator may select a combination of positive buoyant system(s) and negative buoyant system(s) to create a modular untethered downhole tool tailored for different wellbore depths.

Turning to FIG. 1, a wellbore 101 is shown into which a modular untethered downhole tool 100 may be deployed in accordance with some embodiments may be deployed. Modular untethered downhole tool 100 is shown in several states (e.g., 100*a*, 100*b*, 100*c*) for measuring properties (e.g., collecting data) as it moves within wellbore 101. As modular untethered downhole tool 100 moves within wellbore 101 it may sense various properties or parameters and log those properties or parameters. Such properties may be related to one or both of wellbore fluid 109 within wellbore 101, and/or a rock formation 115 into which wellbore 101 extends.

Modular untethered downhole tool 100 is unattached to a surface 103 from which wellbore 101 extends. As more fully described below, modular untethered downhole tool 100 includes a sensing system, a positive buoyant system that is positively buoyant in wellbore fluid 109, and a negative buoyant system that is negatively buoyant in wellbore fluid 101.

When initially deployed in wellbore 101, modular untethered downhole tool 100 (refer to modular untethered downhole tool 100 in state 100*a*) is negatively buoyant in wellbore fluid 109, and therefore flows in a downward direction 105 into wellbore 101. The rate at which wellbore tool 100 descends is governed by the relative forces generated by sensing system, the positive buoyant system and the negative buoyant system acting in combination. Where the negative buoyancy caused by the negative buoyant system is much greater than the positive buoyancy caused by the positive buoyant system, modular untethered downhole tool 100 will descend relatively fast and/or to greater depths compared to a scenario where the negative buoyancy caused by the negative buoyant system is only slightly greater than the positive buoyancy caused by the positive buoyant system.

At some depth 111 in wellbore 101, some or all of the negative buoyant system of modular untethered downhole tool 100 is either detached or dissolves in wellbore fluid 109 (refer to modular untethered downhole tool 100 in state 100*b*). The negative buoyant system may be any negative buoyant system known in the art including, but not limited to, a magnetically attached weight or a physically attached weight similar to any of those discussed in U.S. Pat. No. 10,900,351 entitled "Method and device for obtaining measurements of downhole properties in a subterranean well" and filed Jul. 11, 2019, by Deffenbaugh et al. The entirety of the aforementioned reference is incorporated herein by reference for all purposes. As another example, the negative buoyant system may include a dissolvable ballast similar to that discussed in the aforementioned U.S. Pat. No. 10,900, 351 reference. As yet another example, the negative buoyant system may be a degradable or dissolvable ballast coupled to an attachment plate similar to that discussed in U.S. patent application Ser. No. 17/949,819 entitled "Untethered Loggin Devices and Related Methods of Logging a Wellbore" and filed Sep. 21, 2022, by Zeghlache. The entirety of the aforementioned reference is incorporated herein by reference for all purposes. Based upon the disclosure provided herein, one of ordinary skill in the art will recognize a variety of negative buoyant systems that may be used in relation to different embodiments.

With the amount of negative buoyancy of the negative buoyant system reduced or completely eliminated, an overall buoyancy of modular untethered downhole tool 100 is changed causing modular untethered downhole tool 100 to begin moving in wellbore 101 in an upward direction 107 (refer to modular untethered downhole tool 100 in state 100*c*). Once returned to surface 103, modular untethered downhole tool 100 can be recovered and any logged data accessed.

Turning to FIGS. 2A-2F, a modular untethered downhole tool system 200 is shown including at least one sensing system 211 having a male threaded portion 218, and a variety of interchangeable positive buoyant systems (a positive buoyant system 220, a positive buoyant system 230, a positive buoyant system 240, and a positive buoyant system 250). An assembly 210 includes sensing system 211 removably attached to an attachment plate 217 and a negative buoyant system 219 that is attached to attachment plate 217. As discussed above, sensing system 211 may be releasably attached to negative buoyant system 219 via attachment plate 217. Such releasable attachment may be actuatable such as, for example, by removing a magnetic field or moving a physical attachment mechanism to release negative buoyant system 219 from sensing system 211. Sensing system 211 includes an interface surface 214. Male threaded portion 218 extends away from interface surface 214 and includes threads 215 extending to a surface 213. Modular untethered downhole tool system 200 may be used to assemble modular untethered downhole tool 100 discussed above in relation to FIG. 1. It is noted that while sensing system 211 has a male threaded portion and the buoyant systems has a corresponding female threaded portion, in other embodiments, sensing system 211 have a female threaded portion and the buoyant systems each have an oppositely (i.e., male) threaded portion. Further, connections types other than threaded connections may be used in relation to different embodiments.

Figure 2A:
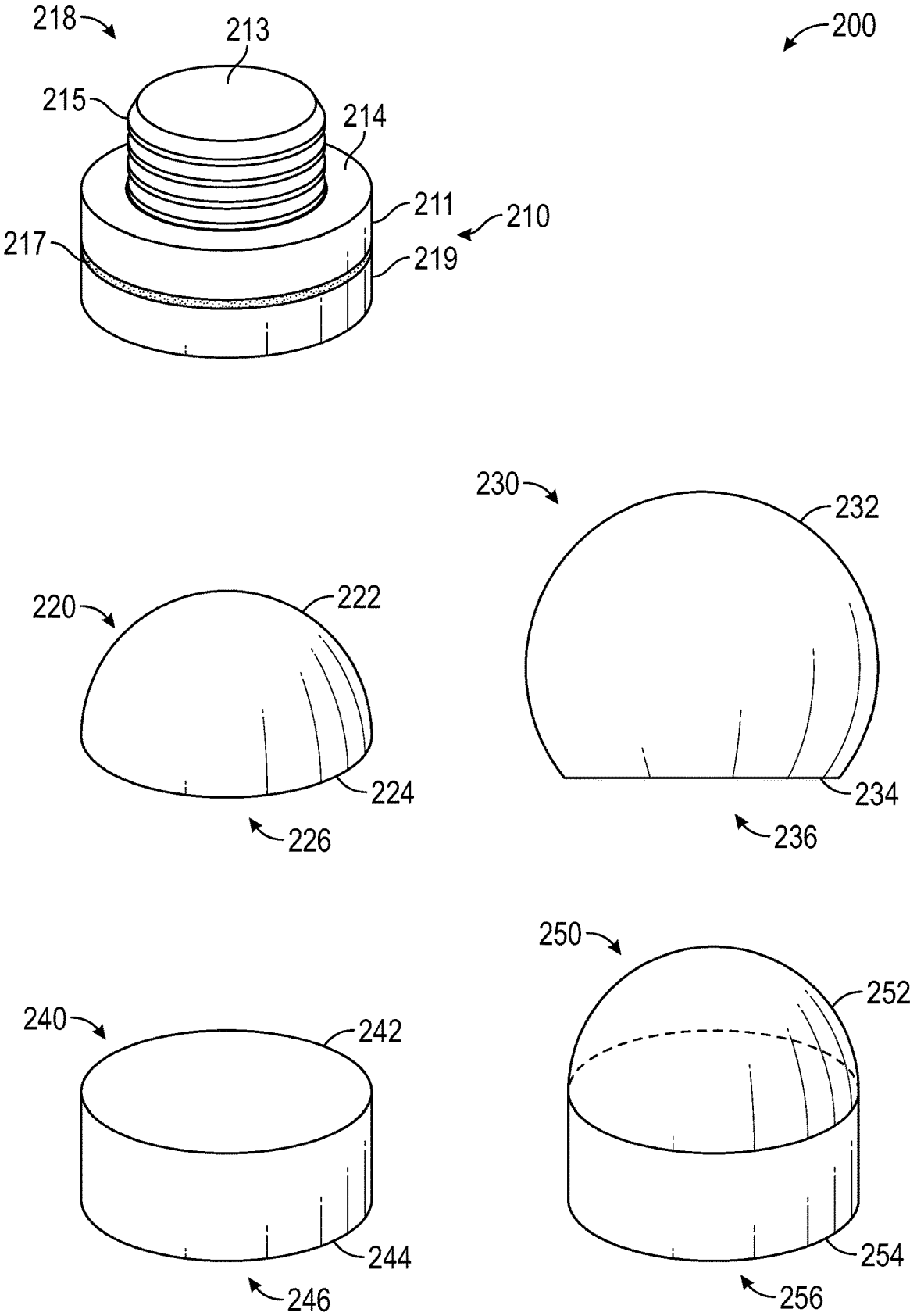
FIGS. 2A-2F show a modular untethered downhole tool system including a sensing system having a threaded portion and a variety of positive buoyant systems each having an oppositely threaded portion in accordance with some embodiments.
Figure 2B:
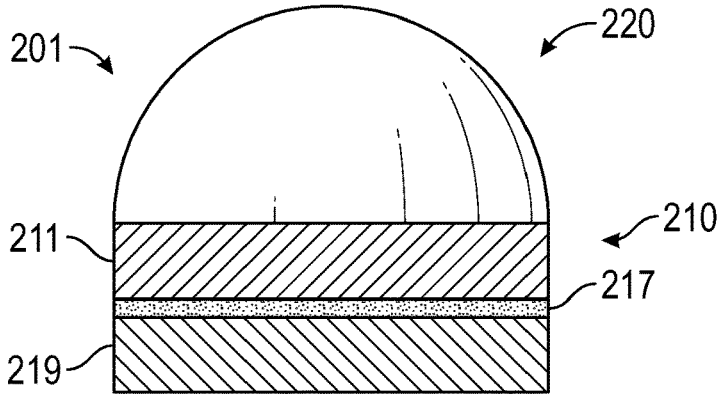
Figure 2C:
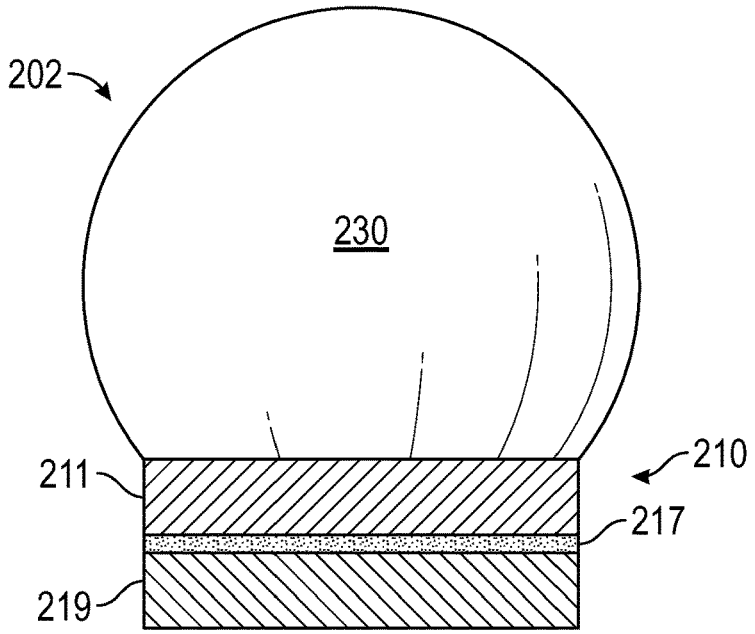
Figure 2D:
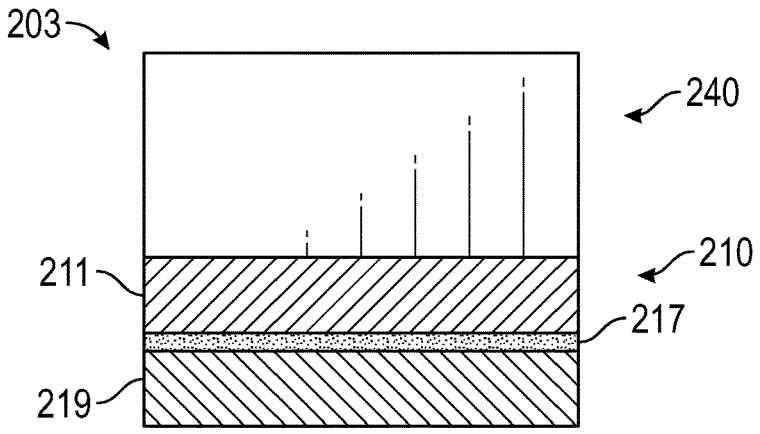
Figure 2E:
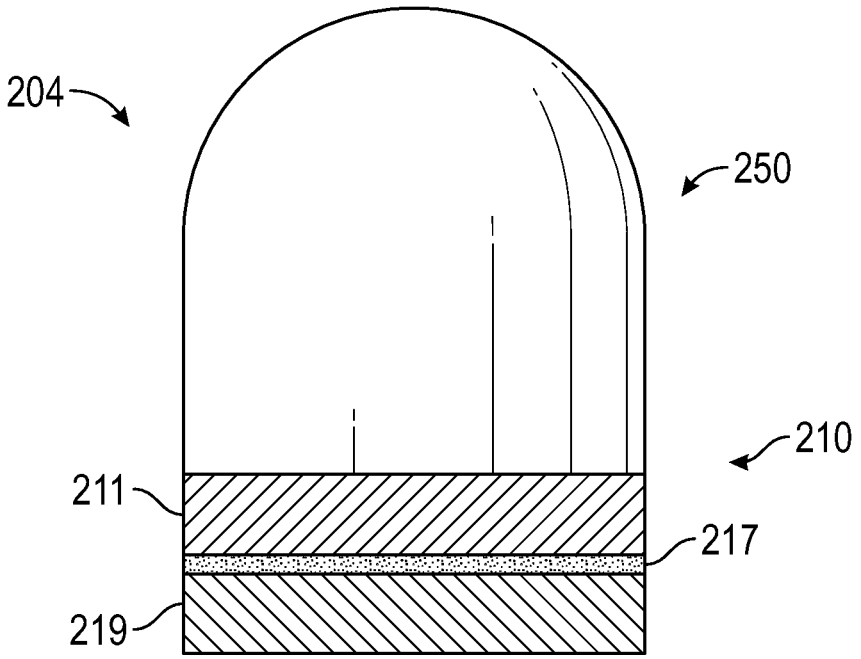
Figure 2F:
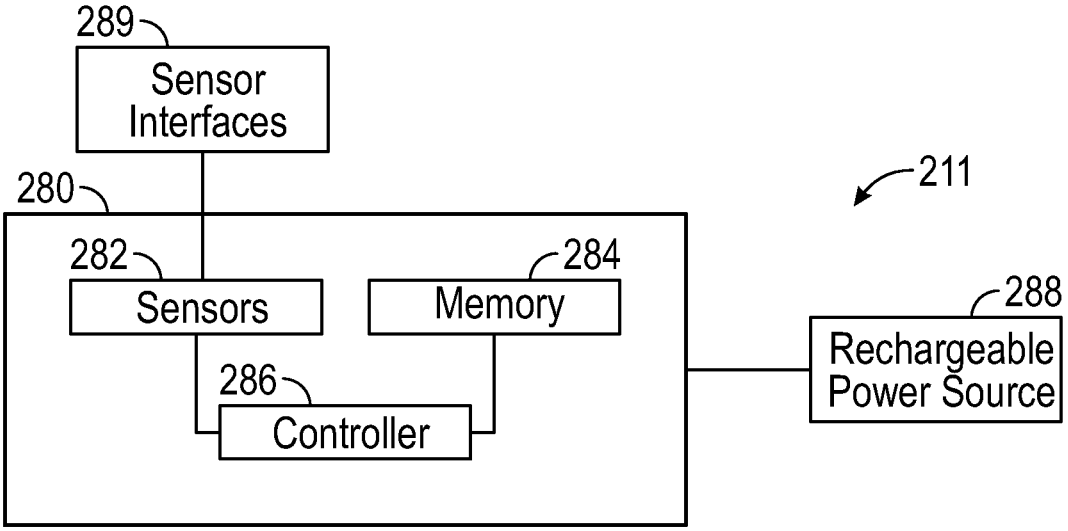

Sensing system 211 includes a housing (comprising a cylindrical region and male threaded portion 218) that contains sensor interfaces 289, electronic components 280, and a rechargeable power source 288 as shown in FIG. 2F. The housing may be made of steel, plastic, aluminum, or another suitable material. Rechargeable power source 288 may be any rechargeable power source known in the art including, but not limited to, a lithium-ion battery or a nickel cadmium battery. Based upon the disclosure provided herein, one of ordinary skill in the art will recognize a variety of rechargeable power sources that may be used in relation to different embodiments.

Electronic components 280 include, but are not limited to, sensors 282, a controller 286, and a memory 284. In some embodiments, memory 284 is configured to store sensed data received from sensors 282 and to store computer executable instructions. Controller 286 may be any electronic circuitry capable of controlling one or more actions of sensing system 211. In some embodiments, controller 286 includes a processor configured to access the computer executable instructions from memory 284 and to execute the computer executable instructions to perform a defined series of actions. The defined series of actions may include, but are not limited to, releasing negative buoyant system 219, receiving sensed data from sensors 282, and/or processing data from sensors 282. The series of actions and/or sensors may include a subset of those actions and/or sensors disclosed in the aforementioned U.S. Pat. No. 10,900,351 reference that was previously incorporated herein by reference for all purposes. Based upon the disclosure provided herein, one of ordinary skill in the art will recognize a variety of actions and/or corresponding sensors that may be performed and/or controlled by controller 286 in accordance with different embodiments.

Sensing system 211 may be described as a density and a volume. A combination of the density and the volume may be used to characterize a buoyancy of sensing system 211. Based upon the disclosure provided herein, one of ordinary skill in the art will recognize a variety of ways that the buoyancy of sensing system 211 may be characterized in accordance with different embodiments. The volume of sensing system 211 is its overall volume including the cylindrical portion and male threaded portion 218. The density of sensing system is a composite density of all of the elements included in sensing system 211 including the housing, the rechargeable power source, the sensors and sensor interfaces, the controller, and the memory.

While FIG. 2A only shows one sensing system, embodiments may include a variety of different sensing systems that are interchangeable. The different sensing systems each include a male threaded portion removably attachable to a selected one of the positive buoyant systems, and include a different set of sensors and/or capabilities allowing a user to pair a desired set of capabilities with a particular positive buoyant system and negative buoyant system. Based upon the disclosure provided herein, one of ordinary skill in the art will recognize a variety of capabilities, sensors, and/or configurations of sensing systems that may be available in accordance with different embodiments. Such capabilities, sensors, and/or configurations may provide for: measuring properties at one or more specified locations along a subterranean well where the properties may include, but are not limited to, a physical, chemical, geological, or structure of a wellbore; programming movement of an untethered device along a sub terranean well; controlling movement within a subterranean well by changing a buoyancy or a drag of the downhole tool when a certain condition occurs including, but not limited to, reaching a programmed distance along the subterranean well, reaching a certain vertical depth in the subterranean well, a passage of a certain amount of time, or a detection of a certain condition within the subterranean well; and/or detecting gaps between ends of casing joints or tubing joints by means of an inductive detector including two identical short solenoid coils of wire having the same radius, length, and number of turns and positioned on the downhole tool such that they have a common axis. The aforementioned physical, chemical, and structural properties of the well may include, but are not limited to, temperature, pressure, water cut (i.e., an amount of water or brine present in downhole fluids), volume fractions of brine and of hydrocarbons in the downhole fluids, flow rate of oil, water, and gas phases, inflow rate of the oil, water, and gas into the wellbore from surrounding rock formations, the chemical composition of the brine mixture, the chemical composition of hydrocarbons, the physical properties of the hydrocarbons including, for example, density or viscosity, the multiphase flow regime, the amount of corrosion or scale on the casing or production tubing, the rates of corrosion or scale buildup, the presence or absence of corrosion inhibitor or scale inhibitor that might be added to the open cross-section within the production tubing or borehole which would conventionally be measured by calipers, the acoustical or elastic properties of the surrounding rock, which may be isotropic or anisotropic, the electrical properties of the surrounding rock including, for example, the surrounding rock's resistive or dielectric properties, which may be isotropic or anisotropic, the density of the surrounding rock, the presence or absence of fractures in the surrounding rock and the abundance, orientation, and/or aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, and the surface tension of fluid interfaces in the surrounding rock. Based upon the disclosure provided herein, one of ordinary skill in the art will recognize a variety of sensor types and/or combinations thereof that may be included in a sensing system in accordance with different embodiments.

Positive buoyant system 220 includes a buoyant material in a half dome shape 222. A female threaded portion 226 extends from an interface surface 224 into half dome shape 222. The threads of female threaded portion 226 are configured to thread onto threads 215 of sensing system 211 until interface surface 224 fits against interface surface 214. By screwing positive buoyant system 220 onto male threaded portion 218, a custom modular untethered downhole tool 201 shown in FIG. 2B is created.

Positive buoyant system 220 may be described as a density and a volume. A combination of the density and volume may be used to characterize a buoyancy of positive buoyant system 220. Based upon the disclosure provided herein, one of ordinary skill in the art will recognize a variety of ways that the buoyancy of positive buoyant system 220 may be characterized in accordance with different embodiments. The volume is the overall volume of half dome shape 222 less the volume of the opening for threaded female portion 226 extending into half dome shape 222. The density is the composite density of the buoyant material. In some embodiments, the buoyant material may be foam formed in half dome shape 222. In such a scenario, the density of positive buoyant system 220 is the density of the foam. In other embodiments, the buoyant material may be a sealed plastic, fiberglass, or metal shell in half dome shape 222 where the shell is filled with a material of defined buoyancy such as, for example, water or air. In such a scenario, the density of positive buoyant system 220 is the composite density of the shell and the material within the shell. Based upon the disclosure provided herein, one of ordinary skill in the art will recognize a variety of buoyant materials that may be used in relation to different embodiments, and corresponding densities used to describe positive buoyant system 220.

Positive buoyant system 230 includes a buoyant material in a globe shape 232. A female threaded portion 236 extends from an interface surface 234 into globe shape 232. The threads of female threaded portion 236 are configured to thread onto threads 215 of sensing system 211 until interface surface 234 fits against interface surface 214. By screwing positive buoyant system 230 onto male threaded portion 218, a custom downhole tool 202 shown in FIG. 2C is created.

Positive buoyant system 230 may be described as a density and a volume. A combination of the density and the volume may be used to characterize a buoyancy of positive buoyant system 230. Based upon the disclosure provided herein, one of ordinary skill in the art will recognize a variety of ways that the buoyancy of positive buoyant system 230 may be characterized in accordance with different embodiments. The volume is the overall volume of globe shape 232 less the volume of the opening for threaded female portion 236 extending into globe shape 232. The density is the composite density of the buoyant material. In some embodiments, the buoyant material may be foam formed in globe shape 232. In such a scenario, the density of positive buoyant system 230 is the density of the foam. In other embodiments, the buoyant material may be a sealed plastic, fiberglass, or metal shell in globe shape 232 where the shell is filled with a material of defined buoyancy such as, for example, water or air. In such a scenario, the density of positive buoyant system 230 is the composite density of the shell and the material within the shell. Based upon the disclosure provided herein, one of ordinary skill in the art will recognize a variety of buoyant materials that may be used in relation to different embodiments, and corresponding densities used to describe positive buoyant system 230.

Positive buoyant system 240 includes a buoyant material in a cylinder shape 242. A female threaded portion 246 extends from an interface surface 244 into cylinder shape 242. The threads of female threaded portion 246 are configured to thread onto threads 215 of sensing system 211 until interface surface 244 fits against interface surface 214. By screwing positive buoyant system 240 onto male threaded portion 218, a custom downhole tool 203 shown in FIG. 2D is created.

Positive buoyant system 240 may be described as a density and a volume. A combination of the density and the volume may be used to characterize a buoyancy of positive buoyant system 240. Based upon the disclosure provided herein, one of ordinary skill in the art will recognize a variety of ways that the buoyancy of positive buoyant system 240 may be characterized in accordance with different embodiments. The volume is the overall volume of cylinder shape 242 less the volume of the opening for threaded female portion 246 extending into cylinder shape 242. The density is the composite density of the buoyant material. In some embodiments, the buoyant material may be foam formed in cylinder shape 242. In such a scenario, the density of positive buoyant system 240 is the density of the foam. In other embodiments, the buoyant material may be a sealed plastic, fiberglass, or metal shell in cylinder shape 242 where the shell is filled with a material of defined buoyancy such as, for example, water or air. In such a scenario, the density of positive buoyant system 240 is the composite density of the shell and the material within the shell. Based upon the disclosure provided herein, one of ordinary skill in the art will recognize a variety of buoyant materials that may be used in relation to different embodiments, and corresponding densities used to describe positive buoyant system 240.

Positive buoyant system 250 includes a buoyant material in a bullet shape 252. A female threaded portion 256 extends from an interface surface 254 into bullet shape 252. The threads of female threaded portion 256 are configured to thread onto threads 215 of sensing system 211 until interface surface 254 fits against interface surface 214. By screwing positive buoyant system 250 onto male threaded portion 218, a custom downhole tool 203 shown in FIG. 2D is created.

Positive buoyant system 250 may be described as a density and a volume. A combination of the density and the volume may be used to characterize a buoyancy of positive buoyant system 250. Based upon the disclosure provided herein, one of ordinary skill in the art will recognize a variety of ways that the buoyancy of positive buoyant system 250 may be characterized in accordance with different embodiments. The volume is the overall volume of bullet shape 252 less the volume of the opening for threaded female portion 256 extending into bullet shape 252. The density is the composite density of the buoyant material. In some embodiments, the buoyant material may be foam formed in bullet shape 252. In such a scenario, the density of positive buoyant system 250 is the density of the foam. In other embodiments, the buoyant material may be a sealed plastic, fiberglass, or metal shell in bullet shape 252 where the shell is filled with a material of defined buoyancy such as, for example, water or air. In such a scenario, the density of positive buoyant system 250 is the composite density of the shell and the material within the shell. Based upon the disclosure provided herein, one of ordinary skill in the art will recognize a variety of buoyant materials that may be used in relation to different embodiments, and corresponding densities used to describe positive buoyant system 250.

Figure 3A:
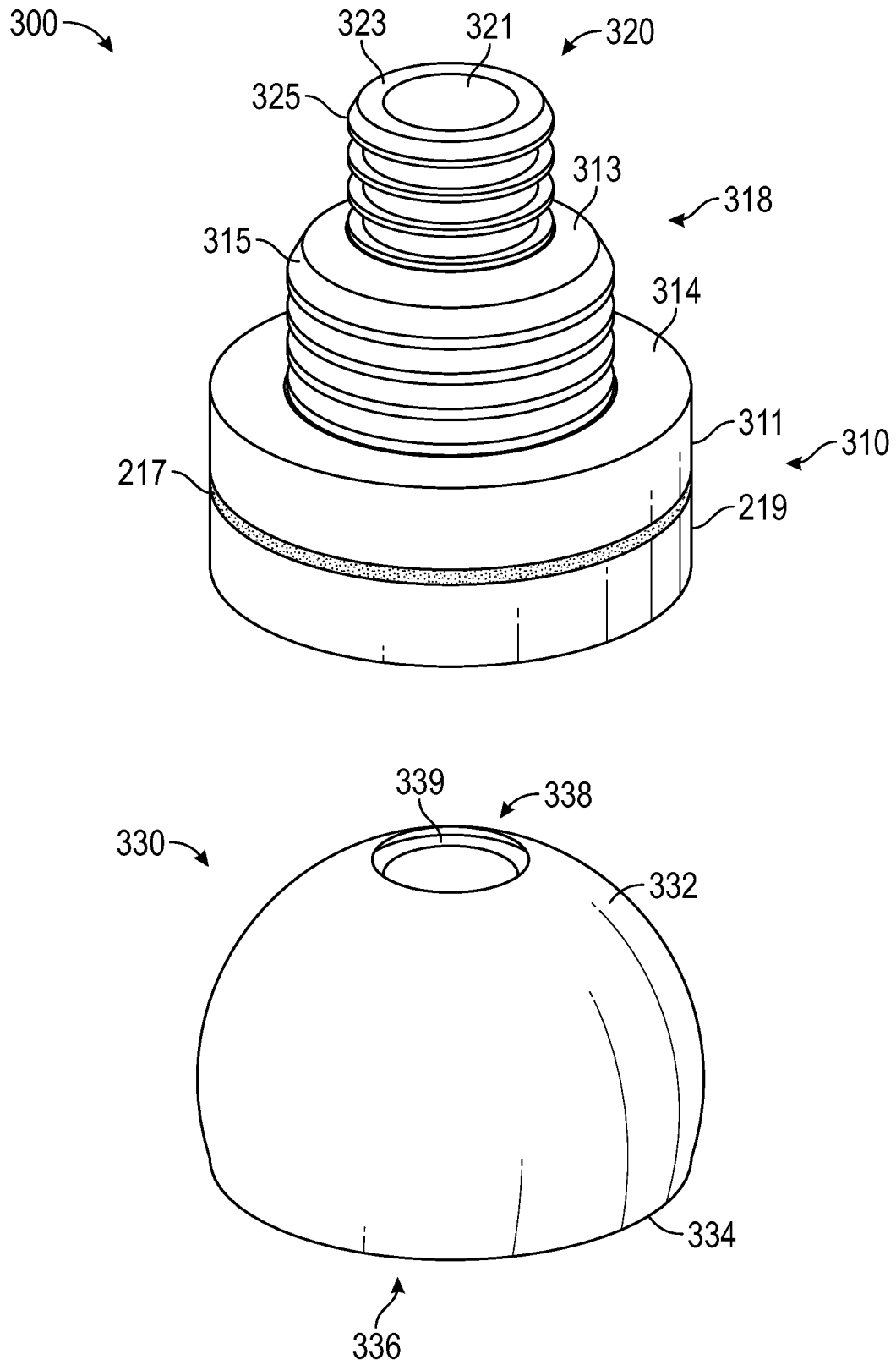
FIGS. 3A-3C show another modular untethered downhole tool system including a sensing system having a threaded portion and a variety of positive buoyant systems each having an oppositely threaded portion in accordance with other embodiments.
Figure 3B:
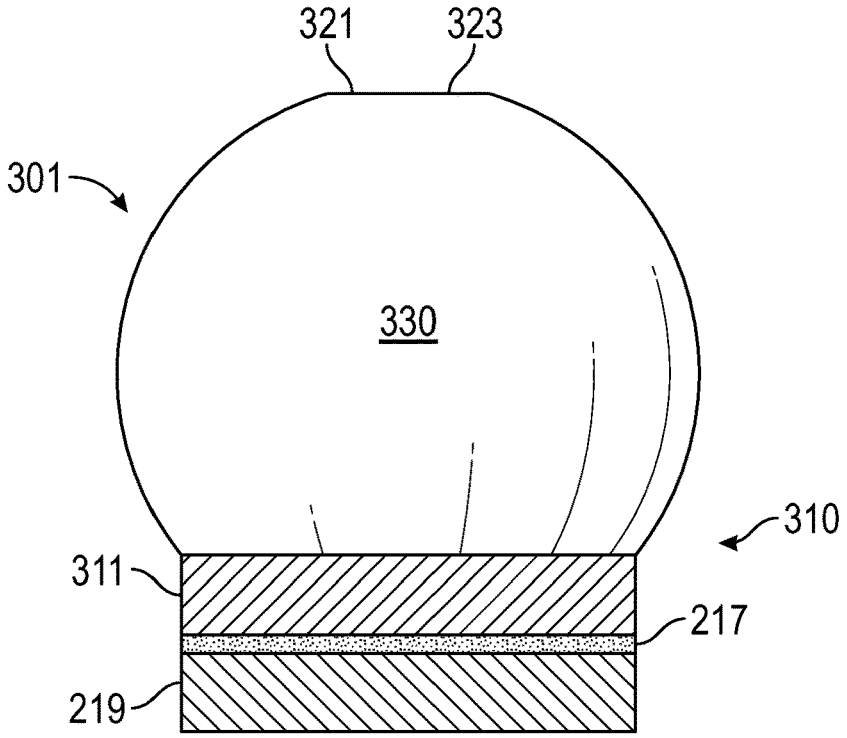
Figure 3C:
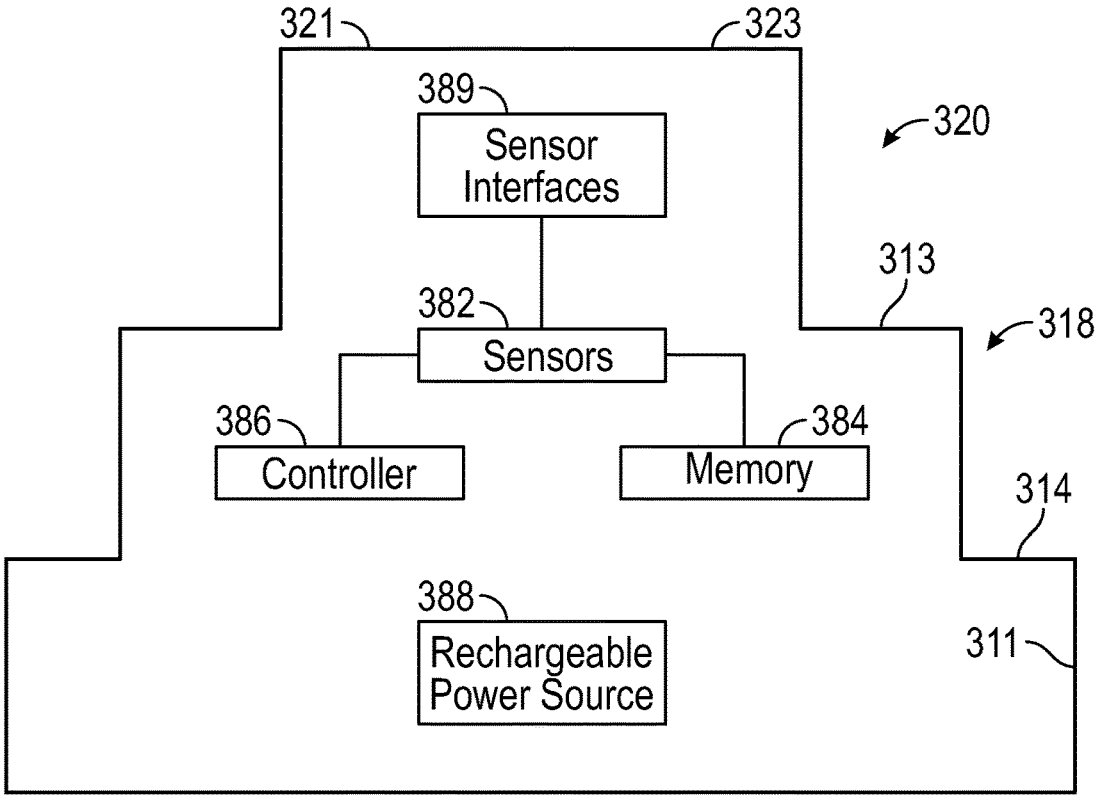

Turning to FIGS. 3A-3C, another modular untethered downhole tool system 300 is shown that includes a sensing system 311 having male threaded portions 318, 320, and a variety of positive buoyant systems (e.g., a positive buoyant system 330). While only one positive buoyant system is shown, modular untethered downhole tool system 300 may include positive buoyant systems similar to those discussed above in relation to FIG. 2A (e.g., positive buoyant system 220 modified to include a sensor interface opening, positive buoyant system 240 modified to include a sensor interface opening, and/or positive buoyant system 250 modified to include a sensor interface opening). Modular untethered downhole tool system 300 may be used to assemble modular untethered downhole tool 100 discussed above in relation to FIG. 1.

An assembly 310 includes sensing system 311 removably attached to attachment plate 217 and negative buoyant system 219 that is attached to attachment plate 217. As discussed above, sensing system 311 may be releasably attached to negative buoyant system 219 via attachment plate 217. Such releasable attachment may be actuatable such as, for example, by removing a magnetic field or moving a physical attachment mechanism to release negative buoyant system 219 from sensing system 311. Sensing system 311 includes an interface surface 314. Male threaded portion 318 extends away from interface surface 314 and includes threads 315 extending to a surface 313, and male threaded portion 320 extends away from surface 313 and includes threads 325 extending to a surface 323. A sensor interface area 321 is configured to allow contact or close proximity to one or more sensor interfaces 389 (shown in FIG. 3C). As shown in FIG. 3C, sensor interfaces 389 are disposed in male threaded portion 320 near sensor interface area 321.

Sensing system 311 includes a housing (comprising a cylindrical portion, male threaded portion 318 and male threaded portion 320) that includes an inner volume in which sensor interfaces 389, sensors 382, a controller 386, and a memory 384, and a rechargeable power source 388 may be disposed as shown in FIG. 3C. The housing may be made of steel, plastic, aluminum, or another suitable material. Rechargeable power source 388 may be any rechargeable power source known in the art including, but not limited to, a lithium-ion battery or a nickel cadmium battery. Based upon the disclosure provided herein, one of ordinary skill in the art will recognize a variety of rechargeable power sources that may be used in relation to different embodiments.

In some embodiments, memory 384 is configured to store sensed data received from sensors 382 and to store computer executable instructions. Controller 386 may be any electronic circuitry capable of controlling one or more actions of sensing system 311. In some embodiments, controller 386 includes a processor configured to access the computer executable instructions from memory 384 and to execute the computer executable instructions to perform a defined series of actions. The defined series of actions may include, but are not limited to, releasing negative buoyant system 319, receiving sensed data from sensors 382, and/or processing data from sensors 382. The series of actions and/or sensors may include a subset of those actions and/or sensors disclosed in the aforementioned U.S. Pat. No. 10,900,351 reference that was previously incorporated herein by reference for all purposes. Based upon the disclosure provided herein, one of ordinary skill in the art will recognize a variety of actions and/or corresponding sensors that may be performed and/or controlled by controller 386 in accordance with different embodiments.

While FIG. 3A only shows one sensing system, embodiments may include a variety of different sensing systems that are interchangeable. The different sensing systems each include a male threaded portion removably attachable to a selected one of the positive buoyant systems, and include a different set of sensors and/or capabilities allowing a user to pair a desired set of capabilities with a particular positive buoyant system and negative buoyant system. Based upon the disclosure provided herein, one of ordinary skill in the art will recognize a variety of capabilities, sensors, and/or configurations of sensing systems that may be available in accordance with different embodiments. Such capabilities, sensors, and/or configurations may provide for: measuring properties at one or more specified locations along a subterranean well where the properties may include, but are not limited to, a physical, chemical, geological, or structure of a wellbore; programming movement of an untethered device along a sub terranean well; controlling movement within a subterranean well by changing a buoyancy or a drag of the downhole tool when a certain condition occurs including, but not limited to, reaching a programmed distance along the subterranean well, reaching a certain vertical depth in the subterranean well, a passage of a certain amount of time, or a detection of a certain condition within the subterranean well; and/or detecting gaps between ends of casing joints or tubing joints by means of an inductive detector including two identical short solenoid coils of wire having the same radius, length, and number of turns and positioned on the downhole tool such that they have a common axis. The aforementioned physical, chemical, and structural properties of the well may include, but are not limited to, temperature, pressure, water cut (i.e., an amount of water or brine present in downhole fluids), volume fractions of brine and of hydrocarbons in the downhole fluids, flow rate of oil, water, and gas phases, inflow rate of the oil, water, and gas into the wellbore from surrounding rock formations, the chemical composition of the brine mixture, the chemical composition of hydrocarbons, the physical properties of the hydrocarbons including, for example, density or viscosity, the multiphase flow regime, the amount of corrosion or scale on the casing or production tubing, the rates of corrosion or scale buildup, the presence or absence of corrosion inhibitor or scale inhibitor that might be added to the open cross-section within the production tubing or borehole which would conventionally be measured by calipers, the acoustical or elastic properties of the surrounding rock, which may be isotropic or anisotropic, the electrical properties of the surrounding rock including, for example, the surrounding rock's resistive or dielectric properties, which may be isotropic or anisotropic, the density of the surrounding rock, the presence or absence of fractures in the surrounding rock and the abundance, orientation, and/or aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, and the surface tension of fluid interfaces in the surrounding rock. Based upon the disclosure provided herein, one of ordinary skill in the art will recognize a variety of sensor types and/or combinations thereof that may be included in a sensing system in accordance with different embodiments.

Positive buoyant system 330 includes a buoyant material in a globe shape 332 with a threaded opening extending through globe shape 332. A female threaded portion 336 extends from an interface surface 334 into globe shape 332 at a first circumference and continues to the top of globe shape 332 as a second circumference. The first circumference includes threads (not shown) that are configured to screw onto threads 315. The second circumference includes threads 339 extending to a sensor opening 338 where threads are configured to screw onto threads 325. The threads of female threaded portion 336 are configured to thread onto threads 315 and threads 325 of sensing system 311 until interface surface 334 fits against interface surface 314. By screwing positive buoyant system 330 onto male threaded portion 318, a custom downhole tool 301 shown in FIG. 3B is created.

Positive buoyant system 330 may be described as a density and volume. The volume is the overall volume of globe shape 332 less the volume of the opening for threaded female portion 336 extending through globe shape 332. The density is the composite density of the buoyant material. In some embodiments, the buoyant material may be foam formed in globe shape 332. In such a scenario, the density of positive buoyant system 330 is the density of the foam. In other embodiments, the buoyant material may be a sealed plastic, fiberglass, or metal shell in globe shape 332 where the shell is filled with a material of defined buoyancy such as, for example, water or air. In such a scenario, the density of positive buoyant system 330 is the composite density of the shell and the material within the shell. Based upon the disclosure provided herein, one of ordinary skill in the art will recognize a variety of buoyant materials that may be used in relation to different embodiments, and corresponding densities used to describe positive buoyant system 330.

Figure 4A:
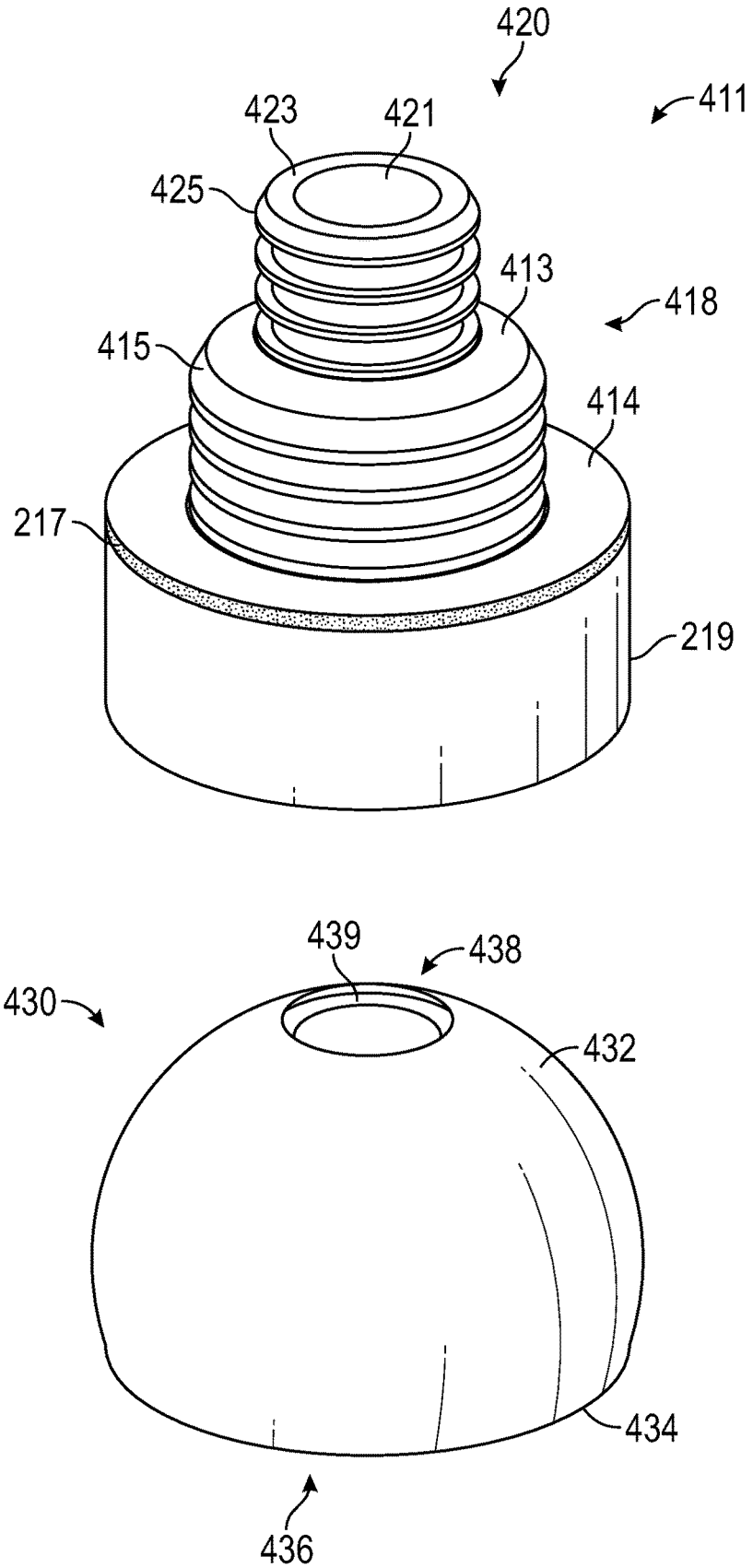
FIGS. 4A-4C show yet another modular untethered downhole tool system including a sensing system having a threaded portion and a variety of positive buoyant systems each having an oppositely threaded portion in accordance with yet other embodiments.
Figure 4B:
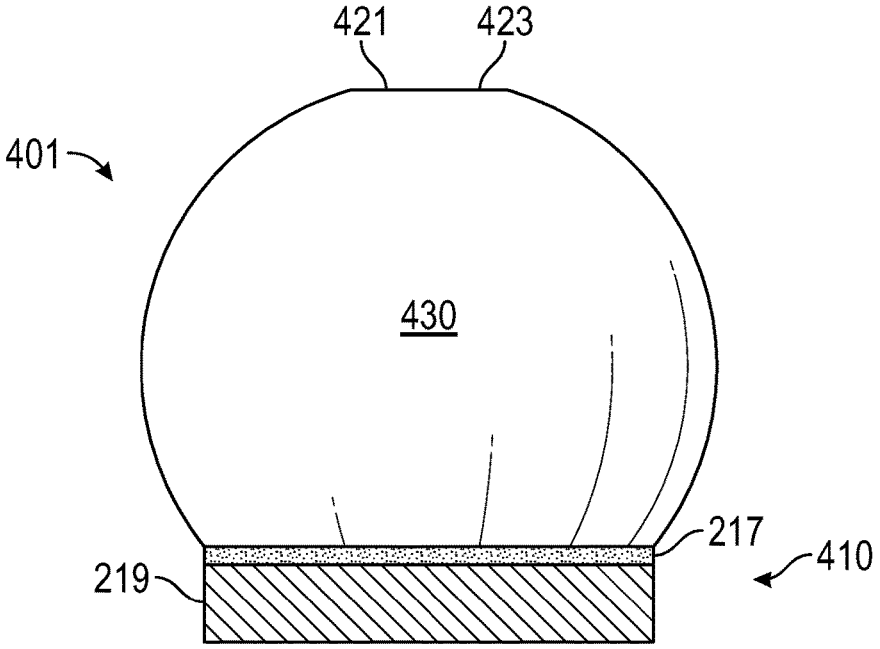
Figure 4C:
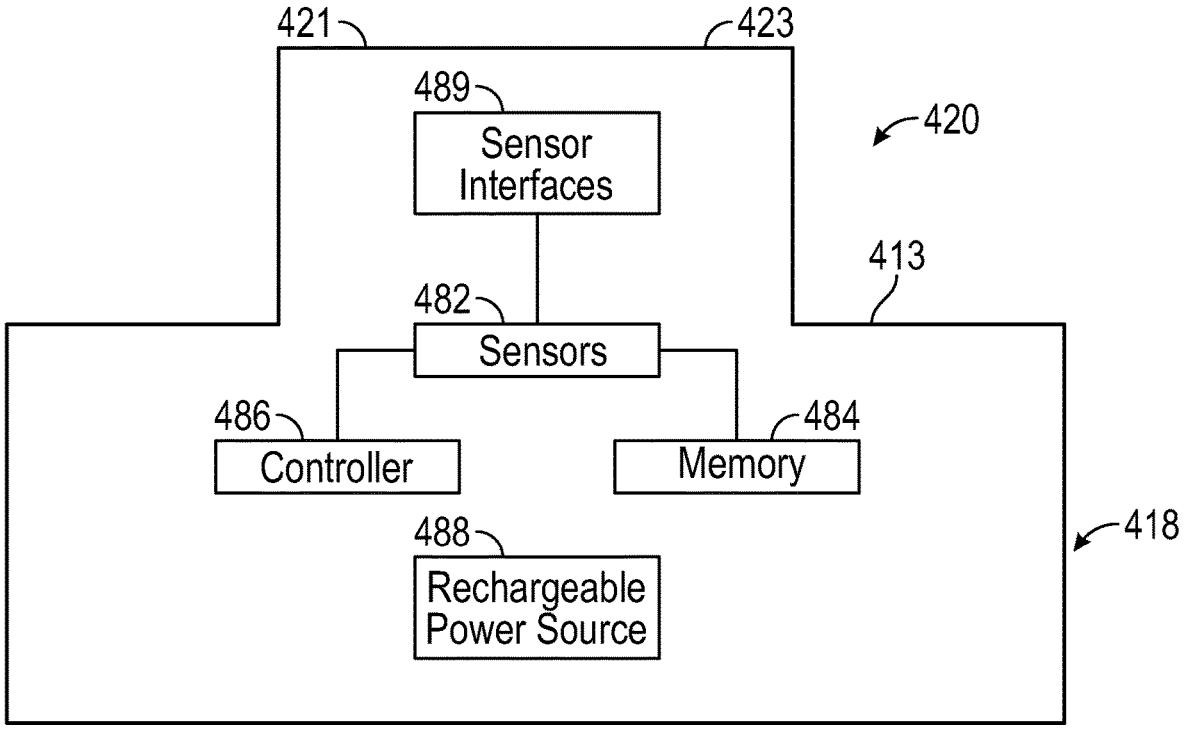

Turning to FIGS. 4A-4C, yet another modular untethered downhole tool system 400 is shown including a sensing system having male threaded portions 418, 420 removably attached to attachment plate 217 and a variety of positive buoyant systems (e.g., a positive buoyant system 430) each having a female threaded portion in accordance with yet other embodiments. As discussed above, sensing system 411 (included in male threaded portions 418, 420) may be magnetically attached to negative buoyant system 219 via attachment plate 217, and/or physically attached to negative buoyant system 219 via attachment plate 217. While only one positive buoyant system is shown, modular untethered downhole tool system 400 may include positive buoyant systems similar to those discussed above in relation to FIG. 2A (e.g., positive buoyant system 220 modified to include a sensor interface opening, positive buoyant system 240 modified to include a sensor interface opening, and/or positive buoyant system 250 modified to include a sensor interface opening). Modular untethered downhole tool system 400 may be used to assemble modular untethered downhole tool 100 discussed above in relation to FIG. 1.

Sensing system 411 is housed in male threaded portions 418, 420 and may be removably attached to attachment plate 217. Negative buoyant system 219 may also be attached to attachment plate 217. Attachment plate 217 includes an interface surface 414. Male threaded portion 418 is attached and extends away from interface surface 414 and includes threads 415 extending to a surface 413, and male threaded portion 420 extends away from surface 413 and includes threads 425 extending to a surface 423. A sensor interface area 421 is configured to allow contact or close proximity to one or more sensor interfaces 489 (shown in FIG. 4C). As shown in FIG. 4C, sensor interfaces 489 are disposed in male threaded portion 420 near sensor interface area 421.

Sensing system 411 includes a housing comprised of male threaded portions 418, 420 that contains sensor interfaces 489, sensors 482, a controller 486, and a memory 484, and a rechargeable power source 488 as shown in FIG. 4C. The housing may be made of steel, plastic, aluminum, or another suitable material. Rechargeable power source 488 may be any rechargeable power source known in the art including, but not limited to, a lithium-ion battery or a nickel cadmium battery. Based upon the disclosure provided herein, one of ordinary skill in the art will recognize a variety of rechargeable power sources that may be used in relation to different embodiments.

In some embodiments, memory 484 is configured to store sensed data received from sensors 482 and to store computer executable instructions. Controller 486 may be any electronic circuitry capable of controlling one or more actions of the sensing system. In some embodiments, controller 486 includes a processor configured to access the computer executable instructions from memory 484 and to execute the computer executable instructions to perform a defined series of actions. The defined series of actions may include, but are not limited to, releasing negative buoyant system 419, receiving sensed data from sensors 482, and/or processing data from sensors 482. The series of actions and/or sensors may include a subset of those actions and/or sensors disclosed in the aforementioned U.S. Pat. No. 10,900,351 reference that was previously incorporated herein by reference for all purposes. Based upon the disclosure provided herein, one of ordinary skill in the art will recognize a variety of actions and/or corresponding sensors that may be performed and/or controlled by controller 486 in accordance with different embodiments.

While FIG. 4A only shows one sensing system, embodiments may include a variety of different sensing systems that are interchangeable. The different sensing systems each include a male threaded portion removably attachable to a selected one of the positive buoyant systems, and include a different set of sensors and/or capabilities allowing a user to pair a desired set of capabilities with a particular positive buoyant system and negative buoyant system. Based upon the disclosure provided herein, one of ordinary skill in the art will recognize a variety of capabilities, sensors, and/or configurations of sensing systems that may be available in accordance with different embodiments. Such capabilities, sensors, and/or configurations may provide for: measuring properties at one or more specified locations along a subterranean well where the properties may include, but are not limited to, a physical, chemical, geological, or structure of a wellbore; programming movement of an untethered device along a sub terranean well; controlling movement within a subterranean well by changing a buoyancy or a drag of the downhole tool when a certain condition occurs including, but not limited to, reaching a programmed distance along the subterranean well, reaching a certain vertical depth in the subterranean well, a passage of a certain amount of time, or a detection of a certain condition within the subterranean well; and/or detecting gaps between ends of casing joints or tubing joints by means of an inductive detector including two identical short solenoid coils of wire having the same radius, length, and number of turns and positioned on the downhole tool such that they have a common axis. The aforementioned physical, chemical, and structural properties of the well may include, but are not limited to, temperature, pressure, water cut (i.e., an amount of water or brine present in downhole fluids), volume fractions of brine and of hydrocarbons in the downhole fluids, flow rate of oil, water, and gas phases, inflow rate of the oil, water, and gas into the wellbore from surrounding rock formations, the chemical composition of the brine mixture, the chemical composition of hydrocarbons, the physical properties of the hydrocarbons including, for example, density or viscosity, the multiphase flow regime, the amount of corrosion or scale on the casing or production tubing, the rates of corrosion or scale buildup, the presence or absence of corrosion inhibitor or scale inhibitor that might be added to the open cross-section within the production tubing or borehole which would conventionally be measured by calipers, the acoustical or elastic properties of the surrounding rock, which may be isotropic or anisotropic, the electrical properties of the surrounding rock including, for example, the surrounding rock's resistive or dielectric properties, which may be isotropic or anisotropic, the density of the surrounding rock, the presence or absence of fractures in the surrounding rock and the abundance, orientation, and/or aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, and the surface tension of fluid interfaces in the surrounding rock. Based upon the disclosure provided herein, one of ordinary skill in the art will recognize a variety of sensor types and/or combinations thereof that may be included in a sensing system in accordance with different embodiments.

Positive buoyant system 430 includes a buoyant material in a globe shape 432 with a threaded opening extending through globe shape 432. A female threaded portion 436 extends from an interface surface 434 into globe shape 432 at a first circumference and continues to the top of globe shape 432 as a second circumference. The first circumference includes threads (not shown) that are configured to screw onto threads 415. The second circumference includes threads 439 extending to a sensor opening 438 where threads are configured to screw onto threads 425. The threads of female threaded portion 436 are configured to thread onto threads 415 and threads 425 of sensing system 411 until interface surface 434 fits against interface surface 414. By screwing positive buoyant system 430 onto male threaded portion 418, a custom downhole tool 401 shown in FIG. 4B is created.

Positive buoyant system 430 may be described as a density and volume. The volume is the overall volume of globe shape 432 less the volume of the opening for threaded female portion 436 extending through globe shape 432. The density is the composite density of the buoyant material. In some embodiments, the buoyant material may be foam formed in globe shape 432. In such a scenario, the density of positive buoyant system 430 is the density of the foam. In other embodiments, the buoyant material may be a sealed plastic, fiberglass, or metal shell in globe shape 432 where the shell is filled with a material of defined buoyancy such as, for example, water or air. In such a scenario, the density of positive buoyant system 430 is the composite density of the shell and the material within the shell. Based upon the disclosure provided herein, one of ordinary skill in the art will recognize a variety of buoyant materials that may be used in relation to different embodiments, and corresponding densities used to describe positive buoyant system 430.

Figure 5:
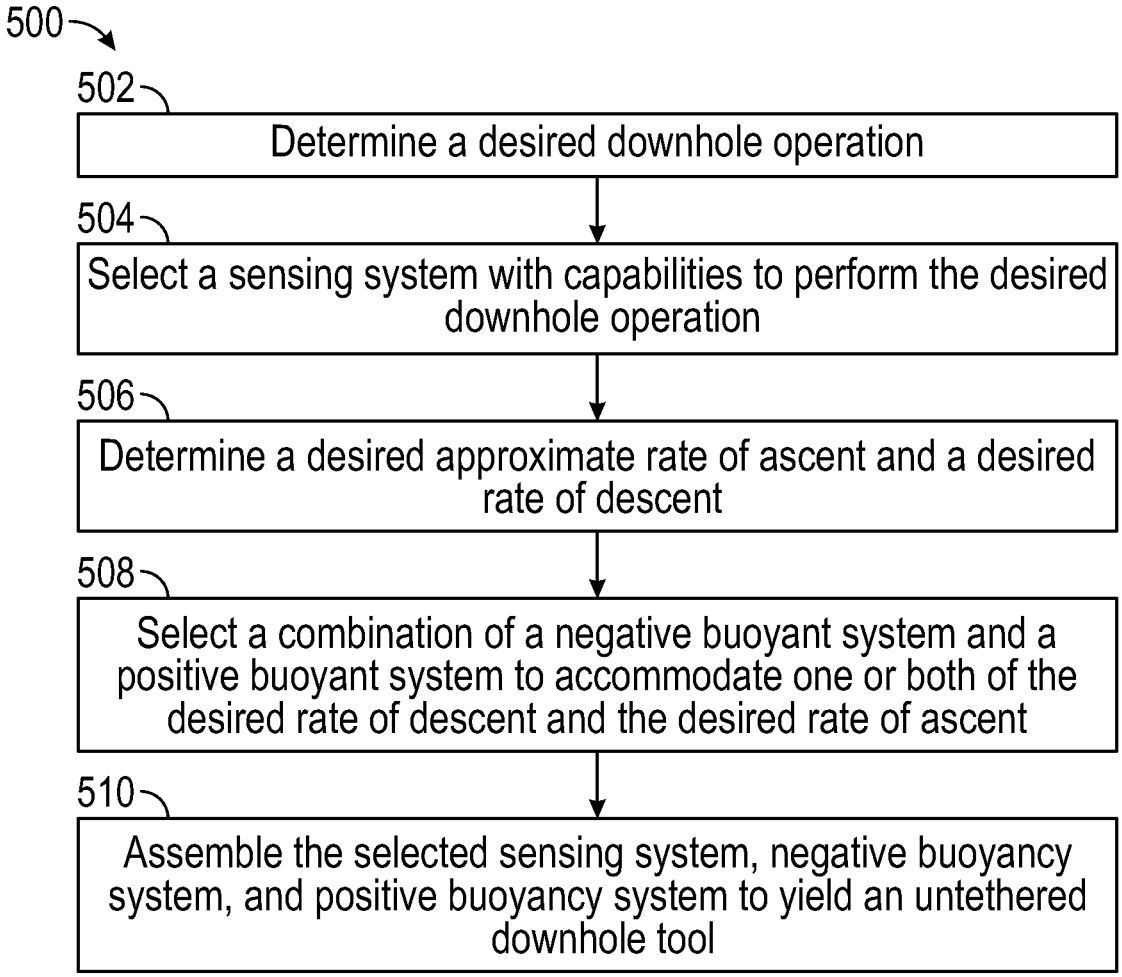
FIG. 5 is a flow diagram showing a method in accordance with some embodiments for creating a custom modular untethered downhole tool.

Turning to FIG. 5, a flow diagram 500 shows a method in accordance with some embodiments for creating a custom modular untethered downhole tool in accordance with various embodiments. Following flow diagram 500, a desired downhole operation is identified (block 502). In some embodiments, more than one downhole operation is desired and identified.

The one or more downhole operations may include, but is not limited to, one or more of: measuring properties at one or more specified locations along a subterranean well where the properties may include, but are not limited to, a physical, chemical, geological, or structure of a wellbore; programming movement of an untethered device along a sub terranean well; controlling movement within a subterranean well by changing a buoyancy or a drag of the downhole tool when a certain condition occurs including, but not limited to, reaching a programmed distance along the subterranean well, reaching a certain vertical depth in the subterranean well, a passage of a certain amount of time, or a detection of a certain condition within the subterranean well; and/or detecting gaps between ends of casing joints or tubing joints by means of an inductive detector including two identical short solenoid coils of wire having the same radius, length, and number of turns and positioned on the downhole tool such that they have a common axis. The aforementioned physical, chemical, and structural properties of the well may include, but are not limited to, temperature, pressure, water cut (i.e., an amount of water or brine present in downhole fluids), volume fractions of brine and of hydrocarbons in the downhole fluids, flow rate of oil, water, and gas phases, inflow rate of the oil, water, and gas into the wellbore from surrounding rock formations, the chemical composition of the brine mixture, the chemical composition of hydrocarbons, the physical properties of the hydrocarbons including, for example, density or viscosity, the multiphase flow regime, the amount of corrosion or scale on the casing or production tubing, the rates of corrosion or scale buildup, the presence or absence of corrosion inhibitor or scale inhibitor that might be added to the open cross-section within the production tubing or borehole which would conventionally be measured by calipers, the acoustical or elastic properties of the surrounding rock, which may be isotropic or anisotropic, the electrical properties of the surrounding rock including, for example, the surrounding rock's resistive or dielectric properties, which may be isotropic or anisotropic, the density of the surrounding rock, the presence or absence of fractures in the surrounding rock and the abundance, orientation, and/or aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, and the surface tension of fluid interfaces in the surrounding rock. Based upon the disclosure provided herein, one of ordinary skill in the art will recognize a variety of sensor types and/or combinations thereof that may be included in a sensing system in accordance with different embodiments.

A sensing system with the capabilities to perform the desired downhole operations is selected (block 504). In some embodiments this may include selecting two or more sensing systems where such is needed to perform all identified downhole operations. As an example, where the downhole operations include measuring temperature at a various depths and measuring pressure at the various depths, a sensing system including a pressure/depth sensor and a temperature sensor may be selected. Based upon the disclosure provided herein, one of ordinary skill in the art will recognize a variety of sensing systems that include sensors and/or computational capability that may be selected to achieve the identified downhole operations.

A desired approximate rate of ascent, rate of descent, and/or wellbore depth of the downhole tool is determined (block 506). The descent of the downhole tool is a function of a composite of the volume and the density of all of positive buoyant systems, negative buoyant systems, and sensing systems that are combined to yield the downhole tool. A combination of a negative buoyant system and a negative buoyant system are selected to achieve the desired rate of descent, the desired rate of ascent, and/or an overall depth (block 508). As the rate of descent is a function of a combined buoyancy value of all of the positive buoyant system, the negative buoyant system, and the sensing system, selection of a positive buoyant system to achieve an overall buoyancy can be used to select a rate of descent. Similarly, as the rate of ascent is a function of a combined buoyancy of the positive buoyant system and the sensing system, selection of a positive buoyant system to achieve an overall buoyancy can be used to select a rate of descent.

For example, where a high rate of descent is desired, a positive buoyant system with a small buoyancy (i.e., small volume and/or relatively high density) relative to that of a negative buoyant system is selected. The buoyancy of the positive buoyant system is sufficient to float the sensing system after separation from the negative buoyant system, but when the negative buoyant system is attached, the downhole tool is very negatively buoyant. Such a downhole tool will ascend relatively slow due to the small buoyancy value of the positive buoyant system.

As another example, where a low rate of descent is desired, a positive buoyant system with a large buoyancy (i.e., high volume and/or relatively low density) relative to that of a negative buoyant system is selected. The buoyancy of the positive buoyant system is small enough to assure that the combination of the positive buoyant system, the sensing system, and the negative buoyant system is negatively buoyant in the fluid in a wellbore, but only sufficiently large to assure negative buoyancy sufficient to reach a desired depth in the wellbore. When the negative buoyant system is detached from the sensing system, the remaining positive buoyant system and sensing system will float toward the surface at a relatively low rate when compared with the preceding example.

The selected sensing system, negative buoyant system, and positive buoyant system are assembled to yield a custom downhole tool tailored to perform the desired downhole operations at desired rates of ascent and/or descent (block 510). In some embodiments, such assembly includes screwing the selected positive buoyant system onto the male threaded portion of the selected sensing system, and magnetically coupling the negative buoyant system to the sensing system. Based upon the disclosure provided herein, one of ordinary skill in the art will appreciate other approaches that may be used for assembly in relation to different embodiments.

Figure 6:
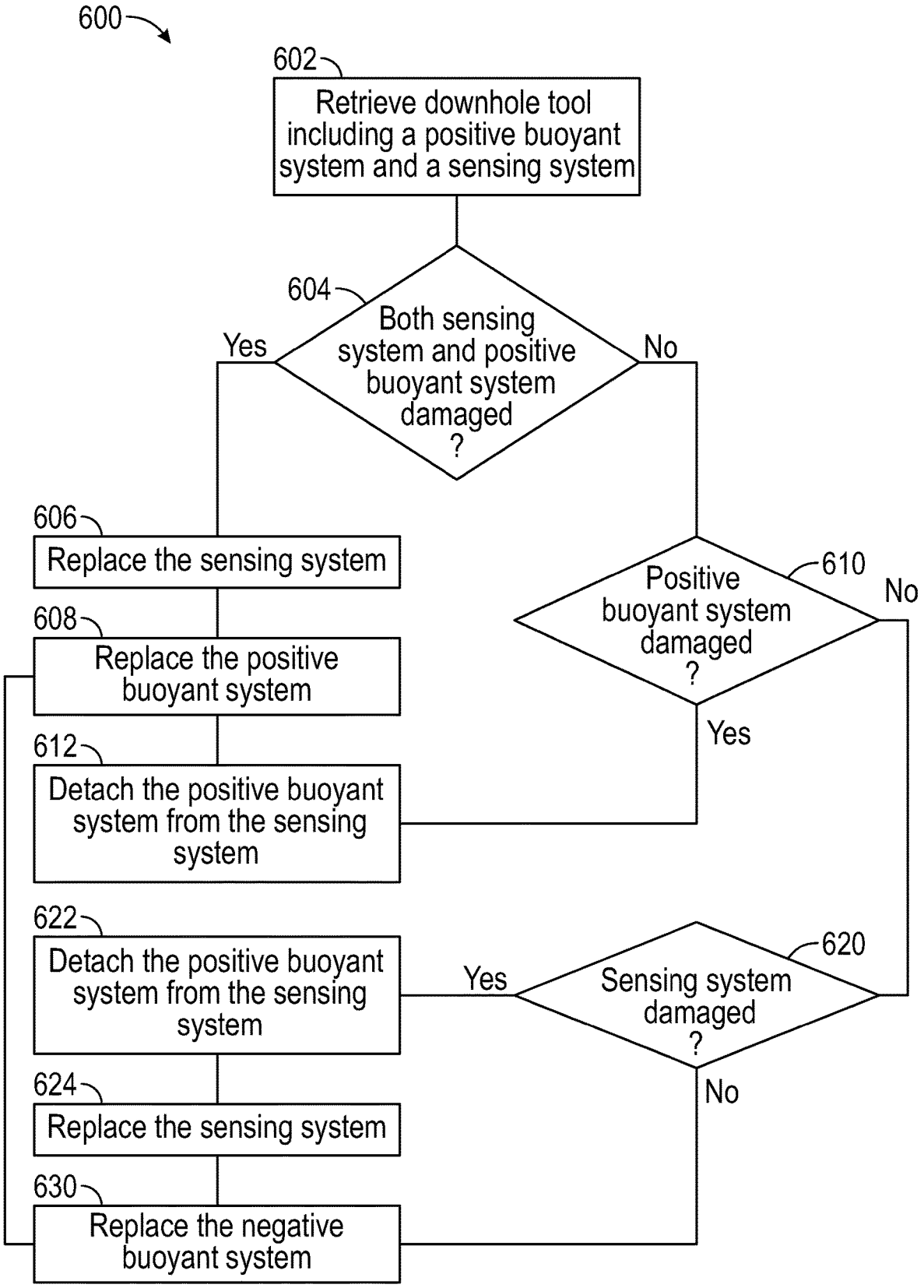
FIG. 6 is a flow diagram showing a method in accordance with some embodiments for salvaging at least a subset of a modular untethered downhole tool.

Turning to FIG. 6, a flow diagram 600 shows a method in accordance with some embodiments for salvaging at least a subset of a modular untethered downhole tool in accordance with some embodiments. Following flow diagram 600, a modular untethered downhole tool is retrieved from a wellbore (block 602). The retrieval may be done, for example, after the modular untethered downhole tool has floated to a surface of the wellbore. Any approach known in the art for retrieving a positively buoyant downhole tool may be used. The retrieved modular untethered downhole tool includes at least one sensing system removably attached to at least one positive buoyant system. In some embodiments, the at least one sensing system is removably attached to the at least one positive buoyant system by screwing one into the other. In some embodiments, the at least one positive buoyant system includes a female threaded portion into which a male threaded portion of the at least one sensing system is threaded. In other embodiments, the at least one sensing system includes a female threaded portion into which a male threaded portion of the at least one positive buoyant system is threaded. In some such embodiments, the female threaded portion is attached to a housing of the sensing system. In another such embodiment, the female threaded portion is formed as part of the housing of the sensing system.

The retrieved modular untethered downhole tool is inspected to determine if both the sensing system and the positive buoyant system are damaged and/or worn out (block 604). Where both are damaged or worn out (block 604), both the sensing system and the positive buoyant system are replaced (blocks 606, 608). Replacement of both the sensing system and the positive buoyant system includes obtaining a replacement sensing system and a replacement positive buoyant system, and attaching the two together. In some embodiments, this includes screwing a male threaded portion of the replacement sensing system into a corresponding female threaded portion of the replacement positive buoyant system. In other embodiments, this includes screwing a male threaded portion of the replacement positive buoyant system into a corresponding female threaded portion of the replacement sensing system.

Alternatively, where both the sensing system and the positive buoyant system are not damaged and/or worn out (block 604), it is determined if only the positive buoyant system is damaged and/or worn out (block 610). A damaged and/or worn out positive buoyant system may be a positive buoyant system from which a portion has been broken off or dented or a positive buoyant system that exhibits a buoyancy that is less than expected for the type of system.

Where the positive buoyant system is damaged and/or worn out (block 610), the damaged or worn out positive buoyant system is detached from the sensing system (block 612). In some embodiments, this may include unscrewing one from the other. A replacement positive buoyant system is obtained and replaced (block 608). Such replacement includes attaching the replacement positive buoyant system to the retrieved and now reused sensing system. In some embodiments, this includes screwing a male threaded portion of the retrieved sensing system into a corresponding female threaded portion of the replacement positive buoyant system. In other embodiments, this includes screwing a male threaded portion of the replacement positive buoyant system into a corresponding female threaded portion of the retrieved sensing system.

Alternatively, where it is determined that the positive buoyant system is not damaged and/or worn out (block 610), it is determined if only the sensing system is damaged and/or worn out (block 620). A damaged and/or worn-out sensing system may be a sensing system that has been dented or crushed, or that has one or more electronic components that are no longer operating properly.

Where the sensing system is damaged and/or worn out (block 620), the positive buoyant system is detached from the damaged and/or worn-out sensing system (block 622). In some embodiments, this may include unscrewing one from the other. A replacement sensing system is obtained and replaced (block 624). Such replacement includes attaching the replacement sensing system to the retrieved and now reused positive buoyant system. In some embodiments, this includes screwing a male threaded portion of the retrieved positive buoyant system into a corresponding female threaded portion of the replacement sensing system. In other embodiments, this includes screwing a male threaded portion of the retrieved positive buoyant system into a corresponding female threaded portion of the replacement sensing system.

A negative buoyant system is replaced (block 630). Attaching the replacement negative buoyant system may be done using any approach known in the art. In some embodiments, this includes activating a magnetic field in the sensing system to attach it to the negative buoyant system. In other embodiments, attaching the replacement negative buoyant system includes securing the replacement negative buoyant system to the sensing system using an adhesive that dissolves in a fluid in a wellbore.

Figure 7A:
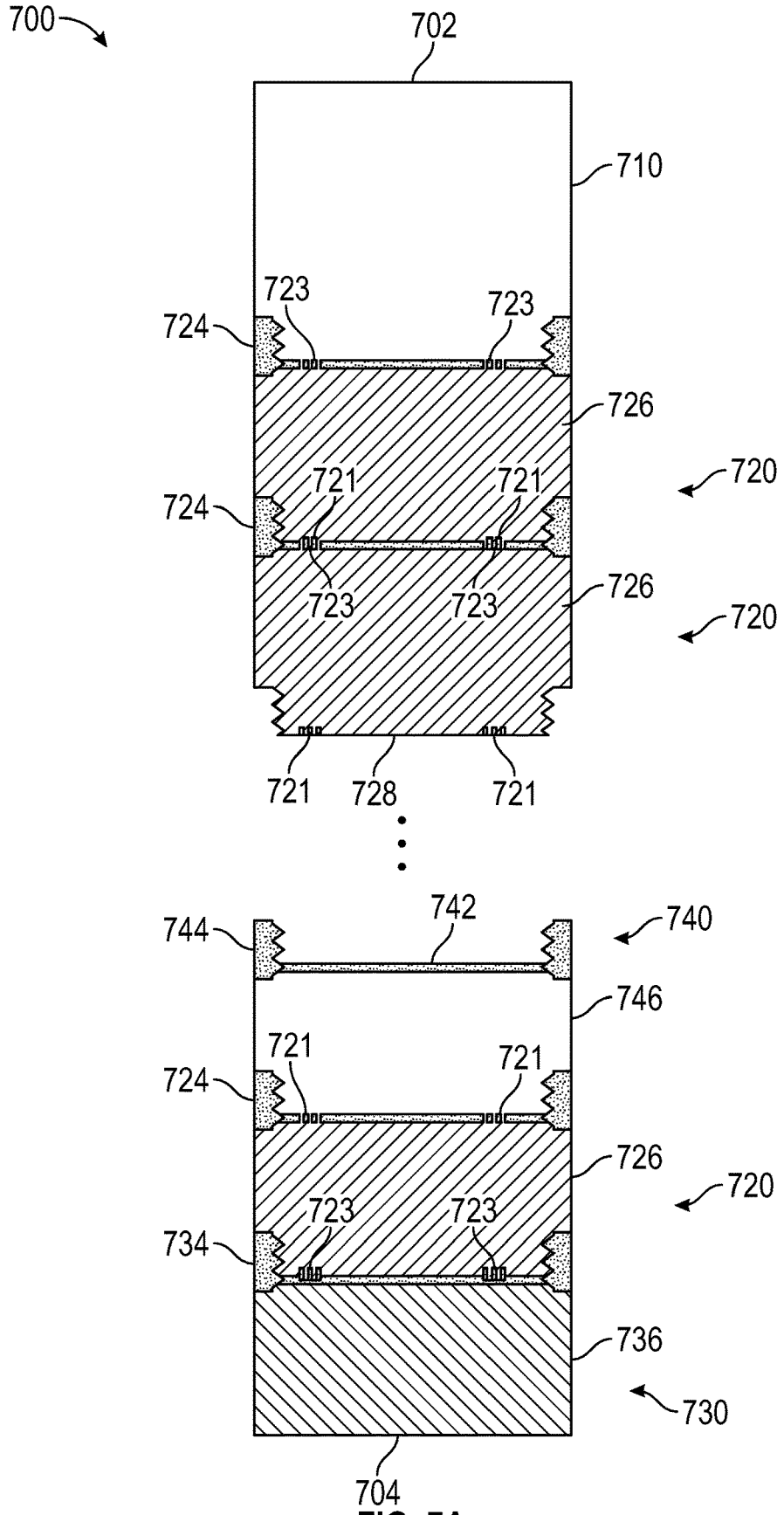
FIGS. 7A-7D show a modular untethered downhole tool system including multiple interchangeable sensor systems and positive buoyant systems in accordance with various embodiments.

Turning to FIGS. 7A-7D, shows a modular untethered downhole tool system 700 including multiple sensor systems 720 and multiple positive buoyant systems 710, 740 in accordance with various embodiments. FIG. 7A shows an example modular untethered downhole tool 700 including a first positive buoyant system 710 attached to a first sensing system 720, and the first sensing system 720 is attached to a second sensing system 720. Positive buoyant system 740 is attached to a third sensing system 720, and the third sensing system 720 is attached to a negative buoyant system 730. One, more than one, or no more sensing systems 720 and/or positive buoyant systems 740 may be disposed between the second sensing system 720 and positive buoyant system 740 as indicated by the three dots.

Each instance of sensing systems 720 may be configured to perform one or more downhole operations that are different from those performed by other instances of sensing systems 720. In some cases, each instance of sensing systems 720 has a different configuration of sensors, controllers, memories, and batteries than other instances of sensing systems 720. Based upon the disclosure provided herein, one of ordinary skill in the art will recognize a variety of capabilities, sensors, and/or configurations of sensing systems that may be available in accordance with different embodiments. Such capabilities, sensors, and/or configurations may provide for: measuring properties at one or more specified locations along a subterranean well where the properties may include, but are not limited to, a physical, chemical, geological, or structure of a wellbore; programming movement of an untethered device along a sub terranean well; controlling movement within a subterranean well by changing a buoyancy or a drag of the downhole tool when a certain condition occurs including, but not limited to, reaching a programmed distance along the subterranean well, reaching a certain vertical depth in the subterranean well, a passage of a certain amount of time, or a detection of a certain condition within the subterranean well; and/or detecting gaps between ends of casing joints or tubing joints by means of an inductive detector including two identical short solenoid coils of wire having the same radius, length, and number of turns and positioned on the downhole tool such that they have a common axis. The aforementioned physical, chemical, and structural properties of the well may include, but are not limited to, temperature, pressure, water cut (i.e., an amount of water or brine present in downhole fluids), volume fractions of brine and of hydrocarbons in the downhole fluids, flow rate of oil, water, and gas phases, inflow rate of the oil, water, and gas into the wellbore from surrounding rock formations, the chemical composition of the brine mixture, the chemical composition of hydrocarbons, the physical properties of the hydrocarbons including, for example, density or viscosity, the multiphase flow regime, the amount of corrosion or scale on the casing or production tubing, the rates of corrosion or scale buildup, the presence or absence of corrosion inhibitor or scale inhibitor that might be added to the open cross-section within the production tubing or borehole which would conventionally be measured by calipers, the acoustical or elastic properties of the surrounding rock, which may be isotropic or anisotropic, the electrical properties of the surrounding rock including, for example, the surrounding rock's resistive or dielectric properties, which may be isotropic or anisotropic, the density of the surrounding rock, the presence or absence of fractures in the surrounding rock and the abundance, orientation, and/or aperture of these fractures, the total porosity or types of porosity in the surrounding rock and the abundance of each pore type, the mineral composition of the surrounding rock, the size of grains or distribution of grain sizes and shapes in the surrounding rock, the size of pores or distribution of pore sizes and shapes in the surrounding rock, the absolute permeability of the surrounding rock, the relative permeability of the surrounding rock, the wetting properties of fluids in the surrounding rock, and the surface tension of fluid interfaces in the surrounding rock. Based upon the disclosure provided herein, one of ordinary skill in the art will recognize a variety of sensor types and/or combinations thereof that may be included in a sensing system in accordance with different embodiments.

Figure 7B:
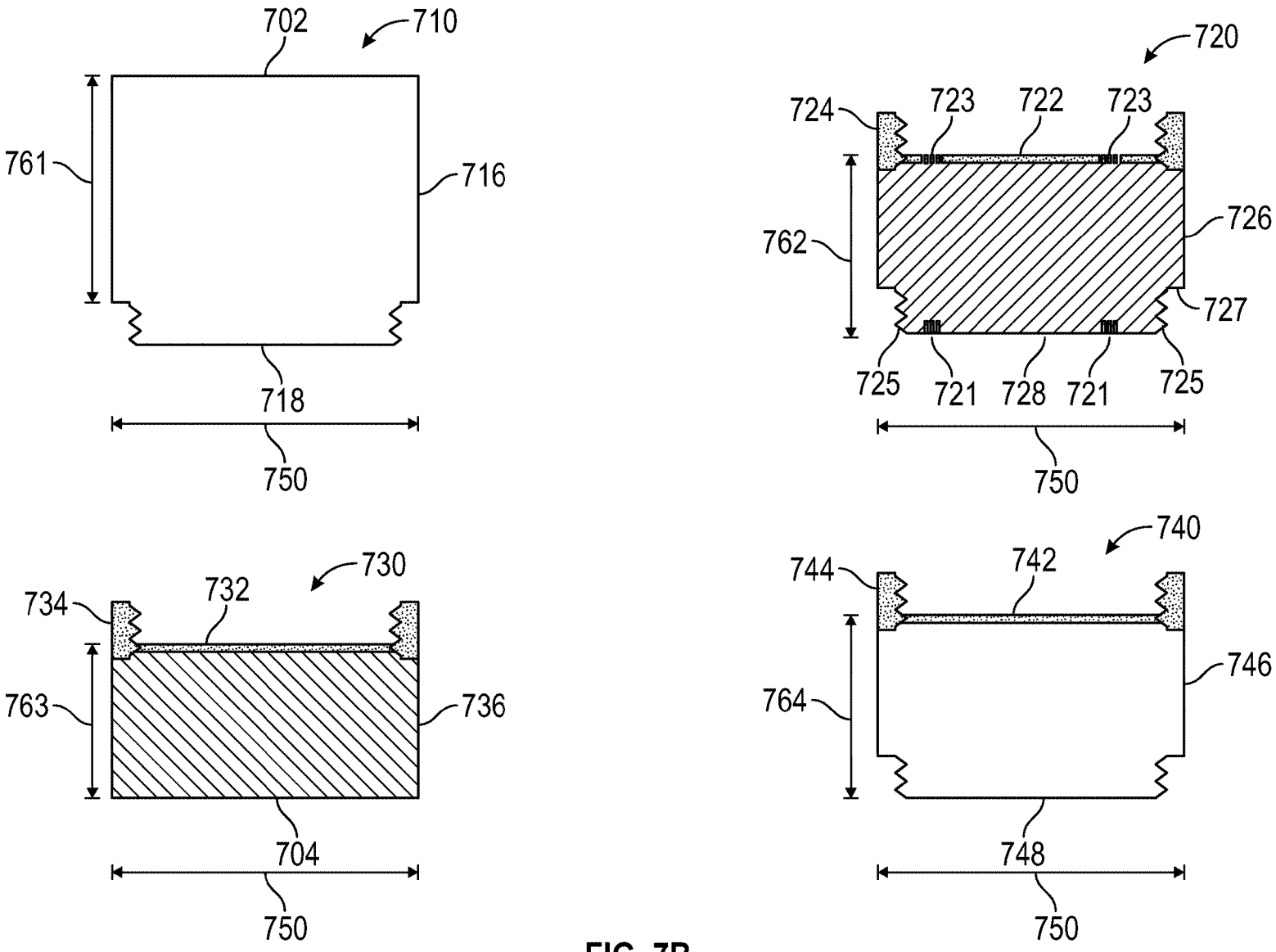

As shown in FIG. 7B, positive buoyant system 710 is a cylinder-shaped body 716 exhibiting a height 761 and a cylinder diameter 750. A top surface 702 is flat and a bottom section is formed as a male threaded portion 718. A body 716 and male threaded portion 718 have a volume and density. A combination of the density and volume may be used to characterize a buoyancy of positive buoyant system 710.

Based upon the disclosure provided herein, one of ordinary skill in the art will recognize a variety of ways that the buoyancy of positive buoyant system 710 may be characterized in accordance with different embodiments. In other embodiments, positive buoyant system 710 may exhibit shapes similar to those discussed above in relation to FIG. 2A (e.g., half dome shape 222, globe shape 232, or bullet shape 252).

The volume is the overall volume of the cylinder shape including body 716 and male threaded portion 718. Different varieties of positive buoyant system 710 may be created having different volumes by modifying height 761 in the different varieties. The density is the composite density of the buoyant material. In some embodiments, the buoyant material may be foam formed in the shape shown. In such a scenario, the density of positive buoyant system 710 is the density of the foam. In other embodiments, the buoyant material may be a sealed plastic, fiberglass, or metal shell in the depicted shape where the shell is filled with a material of defined buoyancy such as, for example, water or air. In such a scenario, the density of positive buoyant system 710 is the composite density of the shell and the material within the shell. Based upon the disclosure provided herein, one of ordinary skill in the art will recognize a variety of buoyant materials that may be used in relation to different embodiments, and corresponding densities used to describe positive buoyant system 710.

As shown in FIG. 7B, sensing system 720 is a cylinder-shaped body 726 exhibiting a height 762 and cylinder diameter 750. A male threaded portion 728 extends from one end of body 726. In some embodiments, male threaded portion 728 is formed integral to body 726. A surface 722 at the opposite end of body 726 is ringed by a female threaded portion 724. In some embodiments, female threaded portion 724 is formed integral to body 726. In other embodiments, female threaded portion 724 is formed separate from body 726 and later attached to body 726. In some such embodiments, female threaded portion 724 is attached to body 726 using an adhesive that dissolves in a fluid in a wellbore at a defined rate. In other such embodiments, female threaded portion 724 is formed of a material that dissolves at a defined rate in the fluid in the wellbore and is attached to body 726 using an adhesive.

The volume is the overall volume of the cylinder shape including body 726, female threaded portion 724, and male threaded portion 728. Different varieties of sensing system 720 may be created having different volumes by modifying height 762 in the different varieties. The density is the composite density of: a housing comprising body 726, female threaded portion 724, and male threaded portion 728; all of the elements included in sensing system 211 including a rechargeable power source, sensors and sensor interfaces, a controller, and a memory; and any material filling the housing such as, for example, air or oil. Each of sensing systems 720 may include circuitry similar to that discussed above in relation to FIG. 2F.

Figure 7C:
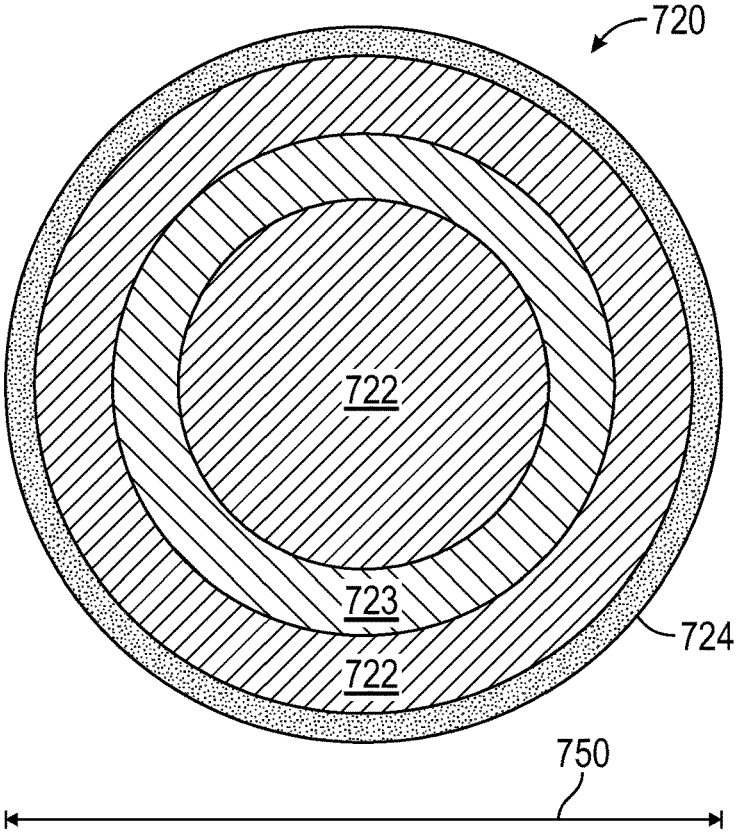

One or more electrodes 723 are formed in surface 722 of body 726 and are configured to conduct electrical signals and/or power from one sensing system to an adjoining sensing system. FIG. 7C shows a top view of sensing system 720 showing electrode 723 disposed in surface 722 and surrounded by female threaded portion 724. Where two or more electrodes are to be formed, they are formed as concentric circles in surface 722 with an insulator (not shown) disposed between.

Figure 7D:
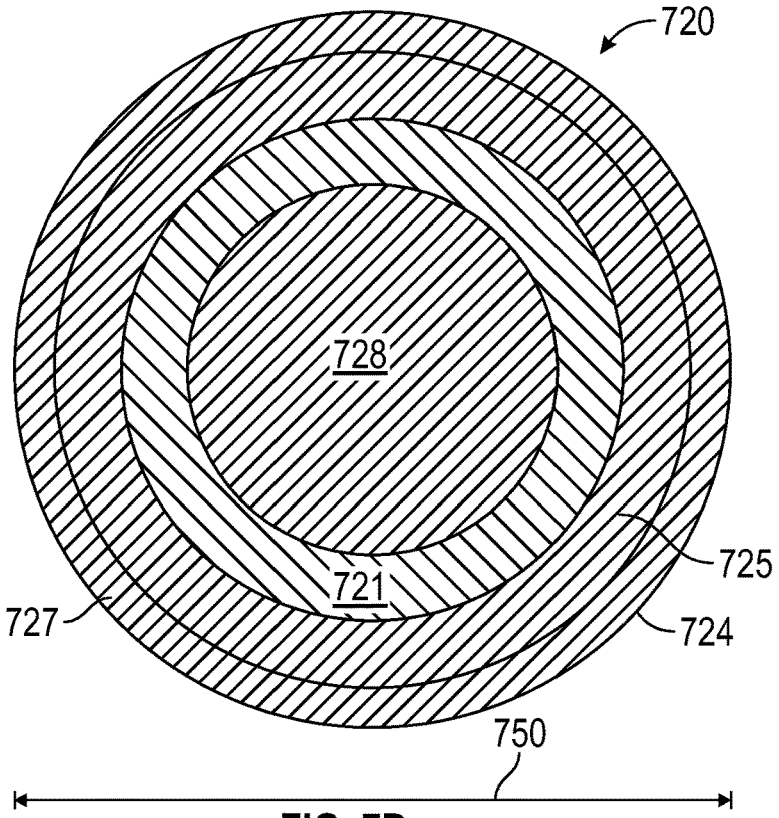

Similarly, one or more electrodes 721 are formed in a surface of male threaded portion 728 and are configured to conduct electrical signals and/or power from one sensing system to an adjoining sensing system. FIG. 7D shows a bottom view of sensing system 720 showing electrode 722 disposed in a surface of male threaded portion 728 including threads 725 and surrounded by a surface 727 of body 726. Where two or more electrodes are to be formed, they are formed as concentric circles in surface 728 with an insulator (not shown) disposed between.

Where two instances of sensing system are attached by screwing male threaded portion 728 of one instance into female threaded portion 724 such that threads 725 of male threaded portion 720 are interleaved with threads of female threaded portion 724 until a surface 772 of body 726 contacts an upper wall of female threaded portion 724, the one or more electrodes 723 of one instance contact the one or more electrodes 721 of the other instances. Electrodes 721, 723 provide for electrical connection and/or communication between sensing systems 720. In some cases, one of the sensing systems is a master system and other of the sensing systems are slave systems controlled by the master system via signals passed via electrodes 721, 723. In other embodiments, signals may be transmitted wirelessly between sensing systems of modular untethered downhole tool system 700. Either way, interaction between sensors within different sensing systems in modular untethered downhole tool system 700 can be configured.

As shown in FIG. 7B, negative buoyant system 730 is a cylinder-shaped body 736 exhibiting a height 763 and cylinder diameter 750. A surface 704 extends along a bottom side of a body 736. While surface 704 is shown as flat, in other embodiments, surface 704 is concave resulting in a dome shape for body 736. A surface 732 at the opposite end of body 736 is ringed by a female threaded portion 734. In some embodiments, female threaded portion 734 is formed integral to body 736. In other embodiments, female threaded portion 734 is formed separate from body 736 and later attached to body 736. In some such embodiments, female threaded portion 734 is attached to body 736 using an adhesive that dissolves in a fluid in a wellbore at a defined rate. In other such embodiments, female threaded portion 734 is formed of a material that dissolves at a defined rate in the fluid in the wellbore and is attached to body 736 using an adhesive.

The volume is the overall volume of the cylinder shape including body 736 and female threaded portion 734. Different varieties of negative buoyant system 730 may be created having different volumes by modifying height 763 in the different varieties. The density is the composite density of the material(s) used to form body 736 and female threaded portion 734. Based upon the disclosure provided herein, one of ordinary skill in the art will recognize a variety of negatively buoyant materials that may be used in relation to different embodiments, and corresponding densities used to describe negative buoyant system 730. The negative buoyant materials may include, but are not limited to, materials that dissolve in a fluid in a wellbore, or materials that dissolve in a fluid in a wellbore impregnated with metal balls.

As shown in FIG. 7B, positive buoyant system 740 is a cylinder-shaped body 746 exhibiting a height 764 and cylinder diameter 750. A male threaded portion 748 extends from one end of body 746. In some embodiments, male threaded portion 748 is formed integral to body 746. A surface 742 at the opposite end of body 746 is ringed by a female threaded portion 744. In some embodiments, female threaded portion 744 is formed integral to body 746. In other embodiments, female threaded portion 744 is formed separate from body 746 and later attached to body 746. In some such embodiments, female threaded portion 744 is attached to body 746 using an adhesive that dissolves in a fluid in a wellbore at a defined rate. In other such embodiments, female threaded portion 744 is formed of a material that dissolves at a defined rate in the fluid in the wellbore and is attached to body 746 using an adhesive.

The volume is the overall volume of the cylinder shape including body 746, female threaded portion 744, and male threaded portion 748. Different varieties of positive buoyant system 740 may be created having different volumes by modifying height 764 in the different varieties. The density is the composite density of the buoyant material and materials used to form female threaded portion 744. In some embodiments, the buoyant material may be foam formed in the shape shown. In such a scenario, the density of positive buoyant system 740 is the density of the foam. In other embodiments, the buoyant material may be a sealed plastic, fiberglass, or metal shell in the depicted shape where the shell is filled with a material of defined buoyancy such as, for example, water or air. In such a scenario, the density of positive buoyant system 740 is the composite density of the shell and the material within the shell. Based upon the disclosure provided herein, one of ordinary skill in the art will recognize a variety of buoyant materials that may be used in relation to different embodiments, and corresponding densities used to describe positive buoyant system 740.

All of positive buoyant system 710, sensing system 720, negative buoyant system 730, and positive buoyant system 740 exhibit cylinder diameter 750 and have male threaded portions and/or female threaded portions of the same size such that each may be threaded and thereby attached to any of the others.

Returning to FIG. 7A, in the initial configuration of modular untethered downhole tool system 700, a combination of the volume and the density of all of the negative buoyant system(s), the positive buoyant system(s), and the sensing system(s) is greater than a density of the fluid such that when deployed in a wellbore modular untethered downhole tool system 700 descends into the wellbore. Later, after negative buoyant system 740 is detached, a combination of the volume and the density of all of the positive buoyant system(s) and the sensing system(s) is less than the density of the fluid such that modular untethered downhole tool system 700 ascends toward a surface of the wellbore.

In some embodiments, female threaded portions associated with different instances of sensing systems 720, positive buoyant systems 740, and negative buoyant systems 730 may be made of materials that dissolve at different rates in a fluid within a wellbore. In some embodiments, three different materials that are dissolvable in liquids expected to be found in a wellbore are used to form different elements. In some such embodiments, the three materials are aluminum, magnesium, and a metallopolymer composite material that each degrade at a different rate. Based upon the disclosure provided herein, one of ordinary skill in the art will recognize a variety of other materials that may be used in relation to different embodiments.

As an example, female threaded portion 734 may be made of a material that dissolves in the fluid in the wellbore at a rate that is faster than the material from which female threaded portion 724 of the third sensing system 720 is made; female threaded portion 724 may be made of a material that dissolves in the fluid in the wellbore at a rate that is faster than the material from which female threaded portion 744 is made; female threaded portion 744 may be made of a material that dissolves in the fluid in the wellbore at a rate that is faster than the material from which female threaded portion 724 of the second sensing system 720 is made; female threaded portion 724 of the second sensing system 720 may be made of a material that dissolves in the fluid in the wellbore at a rate that is faster than the material from which female threaded portion 724 of the first sensing system 720 is made. Such a configuration results in a staged disaggregation of modular untethered downhole tool system 700 over time when deployed within the wellbore. In some embodiments, female threaded portion 734 is not included, but rather negative buoyant system 730 is attached to the third sensing system 720 by a magnetic or releasable physical interface that is controlled by a controller circuit in the third sensing system 720.

Figure 8:
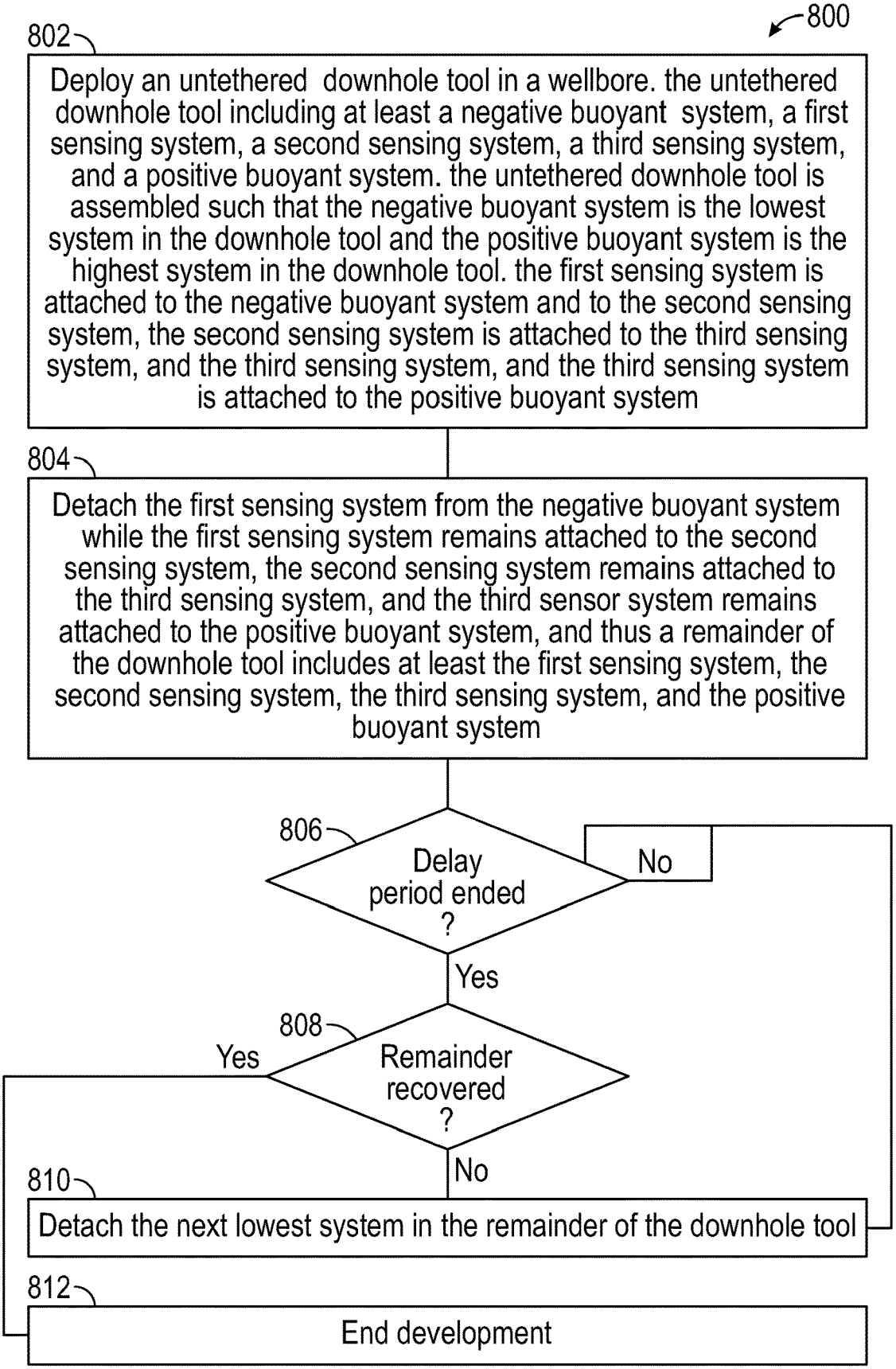
FIG. 8 is a flow diagram showing a method in accordance with some embodiments for staged separation of subsets of a modular untethered downhole tool systems.

Turning to FIG. 8, a flow diagram 800 shows a method in accordance with some embodiments for staged separation of subsets of a modular untethered downhole tool systems in accordance with various embodiments. Following flow diagram 800, an untethered downhole tool is deployed in a wellbore (block 802). The untethered downhole tool includes at least a negative buoyant system, a first sensing system, a second sensing system, a third sensing system, and a positive buoyant system. The first sensing system is attached to the negative buoyant system and to the second sensing system. The second sensing system is attached to the third sensing system, and the third sensing system is attached to the positive buoyant system. While the embodiment is discussed as having three sensing systems, a positive buoyant system, and a negative buoyant system arranged in a particular order, in other embodiments other numbers of sensing systems, positive buoyant systems, and/or negative buoyant systems may be used and arranged in different orders.

In some embodiments, each of the aforementioned systems are threadedly attached to each other by screwing a male threaded portion of one system into a female threaded portion of another system. In other embodiments, the first sensing system is attached to the negative buoyant system using an actuatable attachment. Such an actuatable attachment may include, but is not limited to, a mechanically moveable element attaching the first sensing system is attached to the negative buoyant system, where the mechanically moveable element may be moved to release the attachment under control of a controller disposed in the first sensing system. As another example, such an actuatable element may be a magnetic that selectively generates a magnetic field holding the first sensing system to the negative buoyant system. In either case, the negative buoyant system can be released from the downhole tool within a wellbore under programmable control of the controller (e.g., moving the mechanical)y movable element or reducing the magnetic field). This control may be triggered either remotely from the surface of a wellbore or local to the downhole tool based upon a program running on the controller. In the embodiment, all of the other systems are threadedly attached to each other by screwing a male threaded portion of one system into a female threaded portion of another system. Based upon the disclosure provided herein, one of ordinary skill in the art will recognize a variety of approaches for attachment that may be used in relation to different embodiments.

In some embodiments, a female threaded portion of the first sensing system attached to a male threaded portion of the second sensing system is formed of a material that dissolves in a fluid within a wellbore at a first rate; a female threaded portion of the second sensing system attached to a male threaded portion of the third sensing system is formed of a material that dissolves in a fluid within a wellbore at a second rate; and a female threaded portion of the third sensing system attached to a male threaded portion of the positive buoyant system is formed of a material that dissolves in a fluid within a wellbore at a third rate. The third rate is greater than the second rate, and the second rate is greater than the third rate. In some embodiments, three different materials that are dissolvable in liquids expected to be found in a wellbore are used to form different elements. In some such embodiments, the three materials are aluminum, magnesium, and a metallopolymer composite material that each degrade at a different rate. Based upon the disclosure provided herein, one of ordinary skill in the art will recognize a variety of other materials that may be used in relation to different embodiments.

The first sensing system is detached from the negative buoyant system (block 804). This is done at a time when the first sensing system remains attached to the second sensing system, the second sensing system remains attached to the third sensing system, and the third sensing system remains attached to the positive buoyant system. As such, the remaining downhole tool includes the first sensing system, the second sensing system, the third sensing system, and the positive buoyant system. In some embodiments where the attachment between the first sensing system and the negative buoyant system is an actuatable attachment, a controller in the first sensing system may cause the actuatable attachment to release the negative buoyant element.

A delay period passes (block 806). In embodiments where the material of the female threaded portion of the first sensing system attached to the male threaded portion of the second sensing system dissolves at a first rate, the delay period corresponds to the time required for the female threaded portion of the first sensing system to degrade such that the first sensing system detaches from the second sensing system. The delay, however, is sufficiently long to allow a remaining downhole tool including the first sensing system to float to a surface of the wellbore and be recovered (block 808). Thus, where the delay has passed, but the remaining downhole tool including the first sensing system has been recovered (block 808), the deployment ends without further disintegration of female threaded portions (block 812).

Alternatively, where, for example, the downhole tool becomes stuck in the wellbore and does not float to the surface after detaching the negative buoyant system (block 808), the next lowest system of the downhole tool can be detached (block 810) in hopes of recovering at least some systems of the downhole tool. After detaching the next lowest system in the downhole tool (block 810), the processes of blocks 806-810 are repeated. This approach takes advantage of the different rates at which the respective female threaded portions dissolve in the fluid in the wellbore to provide a staged recovery of at least a subset of the systems of the downhole tool.

Figure 9:
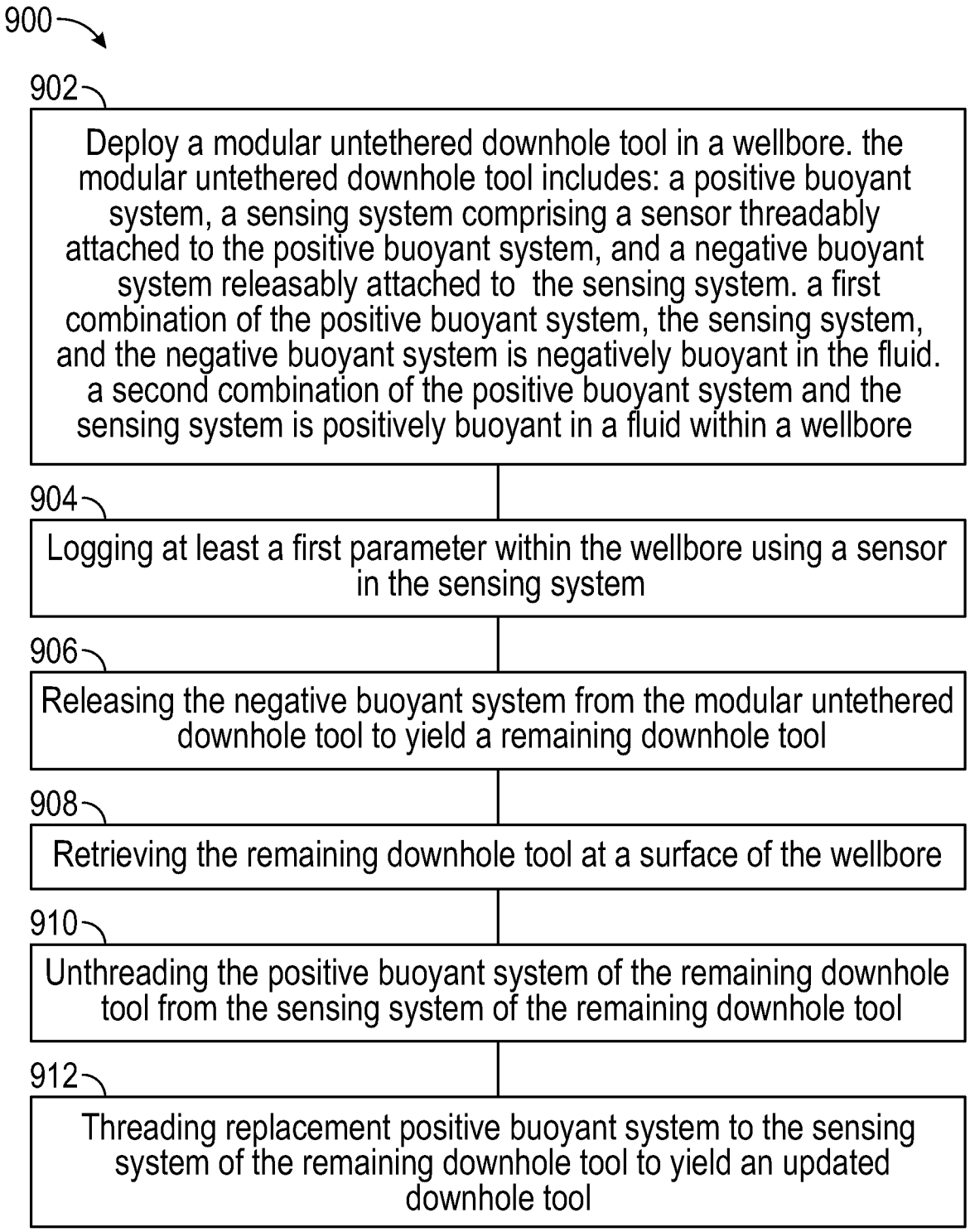
FIG. 9 is a flow diagram showing a method in accordance with some embodiments.

Turning to FIG. 9, a flow diagram 900 shows a method in accordance with some embodiments. Following flow diagram 900, a modular untethered downhole tool is deployed in a wellbore filled with a fluid (block 902). The modular untethered downhole tool includes: a positive buoyant system; a sensing system comprising a sensor threadedly attached to the positive buoyant system; and a negative buoyant system releasably attached to the sensing system. A first combination of the positive buoyant system, the sensing system, and the negative buoyant system is negatively buoyant in the fluid, and a second combination of the positive buoyant system and the sensing system is positively buoyant in the fluid. At least a first parameter within the wellbore is logged using a sensor in the sensing system (block 904). The negative buoyant system is released from the modular untethered downhole tool to yield a remaining downhole tool (block 906). The remaining downhole tool is retrieved at a surface of the wellbore (block 908). The positive buoyant system of the remaining downhole tool is unthreaded from the sensing system of the remaining downhole tool (block 910). A replacement positive buoyant system is threaded to the sensing system of the remaining downhole tool to yield an updated downhole tool (block 912).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A modular untethered downhole tool system for deployment in a fluid in a wellbore, the modular untethered downhole tool system comprising:

a first positive buoyant system exhibiting a first volume and a first density, the first positive buoyant system comprising a first connector;

a second positive buoyant system exhibiting a second volume and a second density, the second positive buoyant system comprising a second connector, wherein a combination of the second volume and the second density provides a greater buoyancy than a combination of the first volume and the first density; and a sensing system, wherein the sensing system comprises:

a housing having an inner volume;

a sensor within the inner volume configured to sense a parameter within the wellbore;

a memory within the inner volume configured to store the parameter;

a controller within the inner volume configured to control storage of the parameter to the memory; and a third connector, wherein the third connector is interchangeably connectable to either of the first connector or the second connector.

2. The system of claim 1, wherein the first connector is a first female threaded connector and the second connector is a second female threaded connector, wherein the third connector is a male threaded connector, wherein a threading size of the first female threaded connector, the second female threaded connector, and the male threaded connector is the same.

3. The system of claim 2, wherein at least one of the sensor, the controller, or the memory is disposed within the male threaded connector.

4. The system of claim 2, wherein the first female threaded connector extends entirely through the first positive buoyant system, and wherein the male threaded connector when attached to the first female threaded connector extends through the first positive buoyant system from a first side of the first positive buoyant system to a second side of the first positive buoyant system.

5. The system of claim 4, wherein the male threaded connector includes a first portion of a first diameter and a first surface, and a second portion of a second diameter extending from the first surface to a second surface, wherein the first diameter is greater than the first diameter.

6. The system of claim 5, wherein both the first portion and the second portion are threaded.

7. The system of claim 1, wherein the first connector is a first male threaded connector and the second connector is a second male threaded connector, wherein the third connector is a female threaded connector, wherein a threading size of the first male threaded connector, the second male threaded connector, and the female threaded connector is the same.

8. The system of claim 1, wherein the modular untethered downhole tool system further comprises:

a negative buoyant system releasably attachable to the sensing system; and wherein a combination of the first positive buoyant system, the sensing system, and the negative buoyant system is negatively buoyant in the fluid in the wellbore; and wherein the first positive buoyant system and the sensing system is positively buoyant in the fluid in the wellbore; and wherein a combination of the second positive buoyant system, the sensing system, and the negative buoyant system is negatively buoyant in the fluid in the wellbore; and wherein the second positive buoyant system and the sensing system is positively buoyant in the fluid in the wellbore.

9. The system of claim 8, wherein the negative buoyant system is releasably attachable to the sensing system by a connection system selected from a group consisting of: a dissolvable connector formed of a material that dissolves in the fluid in the wellbore at a defined rate, and an actuatable attachment.

10. The system of claim 9, wherein the actuatable attachment comprises a mechanically movable element.

11. The system of claim 9, wherein the actuatable attachment comprises an electro-magnet.

12. The system of claim 1, wherein the first positive buoyant system comprises a first material, wherein the second positive buoyant system comprises a second material, wherein the second volume is the same as the first volume, and wherein the second material is more positively buoyant than the first material.

13. The system of claim 1, wherein the first positive buoyant system comprises a first material, wherein the second positive buoyant system comprises a second material, wherein the second volume is greater than the first volume, and wherein the second material is the same as the first material.

14. The system of claim 1, wherein the first connecter is a first female threaded portion, and wherein the first positive buoyant system comprises a foam body into which the first female threaded portion is formed.

15. The system of claim 1, wherein the first positive buoyant system comprises a shell holding a first material, wherein the first material is selected from a group consisting of: water, and air.

16. The system of claim 15, wherein the first connecter is a first female threaded portion, and wherein the shell comprises the first female threaded portion.

17. A method for logging data in a wellbore filled with a fluid, the method comprising:

deploying a modular untethered downhole tool in a wellbore, wherein the modular untethered downhole tool comprises:

a positive buoyant system;

a sensing system comprising a sensor, wherein the sensing system is threadedly attached to the positive buoyant system; and a negative buoyant system releasably attached to the sensing system, wherein a first combination of the positive buoyant system, the sensing system, and the negative buoyant system is negatively buoyant in the fluid, and wherein a second combination of the positive buoyant system and the sensing system is positively buoyant in the fluid;

logging at least a first parameter within the wellbore using the sensor in the sensing system;

releasing the negative buoyant system from the modular untethered downhole tool to yield a remaining downhole tool;

retrieving the remaining downhole tool at a surface of the wellbore;

unthreading the positive buoyant system of the remaining downhole tool from the sensing system of the remaining downhole tool; and threading a replacement positive buoyant system to the sensing system of the remaining downhole tool to yield an updated downhole tool.

18. The method of claim 17, wherein the positive buoyant system has a first volume and comprises a first material, wherein the replacement positive buoyant system has a second volume and comprises a second material, wherein the second volume is the same as the first volume, and wherein the second material is more buoyant than the first material.

19. The method of claim 17, wherein the positive buoyant system has a first volume and comprises a first material, wherein the replacement positive buoyant system has a second volume and comprises a second material, wherein the second volume is greater than the first volume, and wherein the second material is the same as the first material.

20. The method of claim 17, wherein the sensing system comprises a male threaded portion, wherein the positive buoyant system comprises a first female threaded portion, wherein the replacement positive buoyant system comprises a first second female threaded portion, and wherein the male threaded portion can be threaded into either the first female threaded portion or the second female threaded portion.

* * * * *